US005168169A

United States Patent [19]

Brewer, Jr. et al.

[11] Patent Number: 5,168,169

[45] Date of Patent: Dec. 1, 1992

[54] METHOD OF TOOL DEVELOPMENT

[75] Inventors: Harold M. Brewer, Jr., Nashville; Mitchell C. Holman, Smyrna, both of Tenn.

[73] Assignee: Avco Corporation, Providence, R.I.

[21] Appl. No.: 713,399

[22] Filed: Jun. 10, 1991

[51] Int. Cl.[5] ..... G06F 15/46

[52] U.S. Cl. ..... 364/474.07; 72/702; 148/502; 148/695; 364/472

[58] Field of Search ..... 369/474.07, 472; 72/702; 29/DIG. 3; 148/502, 501, 500, 695

[56] References Cited

U.S. PATENT DOCUMENTS 4,819,467 4/1989 Graf et al. ..... 72/702
4,989,439 2/1991 Ewert et al. ..... 72/296

OTHER PUBLICATIONS

"Age Forming Integrally Stiffened, Aluminum Aerospace Structures in an Autoclave" (AIAA 89-2087), Brewer, H., AIAA/AHS/ASEE Aircraft Design, Systems and Operations Conference, Seattle, Wa., Jul. 31-Aug. 2, 1989, pp. 1-12.

"Autoclave Age Forming Large Aluminum Aircraft Panels", Holman, Mitchell C., Journal of Mechanical Working Technology, 20 (1989) 477-488, Elsevier Science Publishers B.V., Amersterdam.

"Age Forming Technology Expanded in a Autoclave", Hambrick, D. M., Society of Automative Engineers, Inc., 1986, pp. 4.649-4.663.

"Metallurgy of Heat Treatment and General Principles of Precipitation Hardending", Chapter 5, Aluminum--Properties and Physical Metallurgy, Ed. Hatch, J. E., American Society for Metals, Metals Park, Ohio, 1984, title page, copyright page, table of contents (2 pages), pp. 134-139 and 177-193.

"Age Forming Aluminum in an Autoclave", H. Brewer, Jr. and M. Holman World Aerospace Technology 1990, Sterling Publications International Limited, London, 1990, cover, pp. 3, 7, 11, and 41-46.

*Primary Examiner*—David H. Malzahn
*Assistant Examiner*—Patrick D. Muir
*Attorney, Agent, or Firm*—Perman & Green

[57] ABSTRACT

A method is disclosed for developing the contour of tools employed for forming aluminum alloy members exhibiting complex shapes. The members are precipitation, heat-treatable, aluminum alloys which are age formed. The resulting member is formed to the desired contour and, simultaneously, is heat treated to reduce residual stresses while improving its strength characteristics. The invention is particularly concerned with a new tool contour prediction method which is based upon the relationship, for a particular aluminum alloy, of the strain retained in a part after it has been subjected to an applied strain while constrained to a desired shape, then released after being heat treated in an autoclave or furnace.

41 Claims, 10 Drawing Sheets

METHOD OF TOOL DEVELOPMENT

BACKGROUND OF THE INVENTION

1. Field of the Invention

The present invention relates generally to a method of developing the contours of forming tools for aluminum alloy members exhibiting complex shapes and, more particularly, to such a method which utilizes the principles of age forming for forming the member being fabricated.

2. Description of the Prior Art

The complex shapes of the contoured members that make up aerospace structures are inherently difficult to form. Due to the shapes required by aerodynamics and because of the emphasis on load carrying capability combined with weight efficiency, optimized designs are created that require complex contours to be produced in high strength, aluminum alloys. Examples of such contoured members would include wing skin panels, fuselage panels, and structural stiffening elements such as spars and stringers for aircraft applications; as well as the shroud, skirt, and tankage members of space launch vehicles. Such members are characterized by extreme metal thickness variations and integrally machined features. The criticality of design requires precise forming tolerances be maintained without sacrificing the fatigue life, reliability, or strength of the member as a result of the forming process chosen.

Conventional forming methods, such as roll forming, brake forming, stretch forming, and peening, are cold working processes that achieve permanent deformations through the application of mechanical bending and/or stretching. Achieving uniform forming across integrally machined features or abrupt changes in thickness may not be possible without specialized tooling or extensive modifications to the forming equipment. In some cases, it may not be possible to develop the deformation forces necessary to accommodate extreme material thicknesses.

While various machines can handle a wide range of metal thicknesses, it is not practical to form metals varying from one extreme of the thickness range to the other, since most machines must be set up prior to operating. From this standpoint, skin tapers and recesses that occur within a panel may not be formable. Forming applications that have openings or cutouts machined into them may not be formable without distorting the opening or leaving flat spots in the contour. Other processes are limited by the size of the forming machinery and those applications that will fit within the working envelope. Custom equipment for larger or smaller applications can be prohibitively costly and inflexible.

In addition to the physical limitations imposed by part geometry are characteristic traits that result from the forming process used. Traits such as strain hardening, residual stresses, and marking accompany many of the forming processes commonly employed. In some cases these effects can produce desirable qualities, such as stress corrosion cracking resistance. Likewise others can produce undesirable qualities, such as a negative effect on the fatigue life and reliability of the formed part. The point to be made is that each forming process must be carefully matched to the intended application.

All of the conventional forming processes mentioned have one important disadvantage in common: each requires the expertise of a skilled operator. With the exception of some processes which have been automated to an extent, considerable operator skill is required to obtain tight tolerances; therefore, process consistency is low. Part to part variations in contour can result in engineering specified contour rework being required on every unit produced. Contour variations that do not require post forming corrections can still cause fit-up problems at assembly. Contour variations from part to part create numerous manufacturing difficulties, each with costly solutions.

In the recent past, a significant advancement of known techniques for forming complex members while maintaining or even improving upon their inherent strength characteristics has been devised. Known as age forming, it is a process that offers many solutions to the problems encountered when conventional cold forming processes are applied to complex shaped contoured members. During age forming, a part is restrained to a predetermined tooling contour and precipitation aged. Age forming is a process that utilizes the phenomenon of metallurgical stress relaxation during precipitation heat treatment for the purpose of converting elastic strain to a plastic state.

The age forming process may be performed on any of the precipitation heat treatable, aluminum alloys in the 2xxx, 6xxx, 7xxx, and 8xxx series.

For example, to date, the age forming process of the invention has been successfully employed on at least the following alloys:

| | |
|---|---|
| 2xxx Series: | 2014 |
| | 2024 |
| | 2124 |
| | 2214 |
| | 2219 |
| | 2419 |
| | 2090 |
| 6xxx Series: | 6013 |
| | 6061 |
| 7xxx Series: | 7075 |
| | 7150 |
| | 7475 |
| 8xxx Series: | 8090 |

Age forming is performed according to standard heat treatment cycles utilized in precipitation hardening of alloys, with particular emphasis on aluminum alloys for purposes of the present invention. The underlying principles of precipitation heat treating are explained in "Aluminum Properties and Physical Metallurgy", Edited by John E. Hatch, *American Society for Metals*, Metals Park, Ohio, 1984, pp. 134–138 and 177–188, which is incorporated herein in its entirety by reference. As a result, suitable applications require the final condition of the formed components to be in an artificially aged temper. Every end use of a structure must be reviewed in light of the property changes that occur as a result of artificial aging. In some cases, the mechanical properties associated with an artificially aged temper may not be suitable for an intended application. As an example, aluminum alloy 2024 loses fracture toughness as it is artificially aged from the T3 to the T8 temper. This change presents a barrier to age forming applications where fracture toughness is a key design element, such as lower wing skins and fuselage panels for aircraft. Material and/or design changes are required in these cases to allow for the utilization of age forming. In other cases, age forming allows the added benefit of being able to produce contours in a strengthened temper, without developing high levels of residual stress within the component. An example of this feature is provided when aluminum alloy 7150 is age formed from the soft W temper to the hardened T6 temper.

More recently, the conventional age forming process has been modified and substantially improved through the use of the autoclave. The autoclave is a computer controlled pressure vessel, with the added benefit of being a certifiable source for heat treating aluminum. Age forming has traditionally been performed in a furnace, where a mechanical means of constraining the part to the predetermined forming shape is required. The autoclave offers the advantage of using vacuum and internal pressure to obtain the desired contour. Since pressure acts uniformly about the surface of the part, integrally machined features receive the same deformation force as the rest of the panel. Another important advantage is that the forming pressure is distributed about the entire surface area of the part. Therefore, a small differential pressure can equate to many tons of applied force when acting over a large surface. Most conventional processes concentrate the forming forces over a small area, thereby restricting the total available deformation force.

The autoclave is computer controlled allowing high levels of process consistency and accuracy. Computer control allows the process to be operator independent. A separate computerized system closely monitors and records the pressure and temperature within the autoclave providing traceability and process verification. These two features inherently endow autoclave age forming with high levels of process consistency and accuracy. Each panel receives the same processing; consequently, repeatability is ensured. It is this feature that makes the process adjustable. The tooling contour is "fine tuned" until the desired results are obtained.

Tooling for the autoclave is designed according to the springback anticipated for the application. Springback refers to the tendency for a member being formed to return to some shape intermediate its original shape and that of the tool to which it is subjected during heat treatment. This phenomenon will be discussed at length below. Forming tools are designed with removable contour boards and other features that allow for rapid contour modifications. Unlike other forming processes, age forming does not typically allow for multiple forming iterations to be performed upon the same piece. Age forming is a heat treatment process; therefore, running a part more than once could result in over aging the material. Until the tooling contour is finalized, contour corrections must be performed by another forming process. Once the final tool contour is reached, secondary corrective forming processes are not necessary.

This inability to repeat the heat treatment process on a member being fabricated requires that it be scrapped if it exhibits an incorrect final contour and the procedure repeated with a new member. The cost of labor and materials for such necessarily repeated iterations of the process have led to the methods of the present invention.

SUMMARY OF THE INVENTION

A method is disclosed for developing the contour of tools employed for forming aluminum alloy members exhibiting complex shapes. The members are precipitation, heat-treatable, aluminum alloys which are autoclave age formed. The resulting member is formed to the desired contour and, simultaneously, is heat treated to reduce residual stresses while improving its strength characteristics. The invention is particularly concerned with a new tooling contour prediction method which is based upon the relationship, for a particular alloy of the strain retained in a part after it has been subjected to an initial or applied strain while constrained to a desired shape, then released after being heat treated in an autoclave.

The method of the invention assures proper results on the first occasion the tool is used, thereby resulting in considerable savings of labor and material.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

In order to gain a better understanding of the phenomena behind the age forming process of the invention, it is well to separately consider and analyze the forming mechanisms at work during the age forming process. This effort can begin by analyzing mechanical forming versus age forming in terms of stress distribution found within the cross section of a specimen undergoing forming. Another tool desirably utilized for analysis is a stress-strain curve representing the outside layer of fibers of a specimen undergoing forming. Through the use of these tools, a clearer picture can be obtained as to how each forming method works to form a piece of material.

Figure 1:
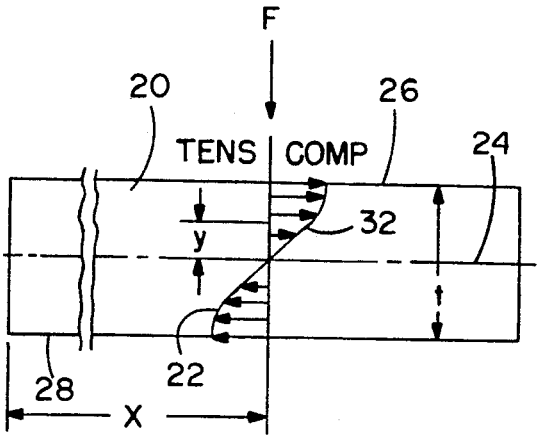
FIG. 1 is a diagrammatic side elevation view illustrative of stress distribution in a constant thickness bar being subjected to pure bending for purposes of explanation of the invention.

Considering the stress distribution throughout a part 20, depicted for simplicity in FIG. 1 as a constant thickness bar of rectangular cross section, allows a comparison to be drawn between different forming mechanisms. As a force F is supplied to the bar between its ends to cause it to assume a radius, stresses diagrammatically indicated at 22 are distributed throughout the thickness of the bar. A neutral surface 24 experiences no stress due to pure bending while the outside fibers experience the greatest stress. A concave side 26 of the bar experiences compressive stresses while a convex side 28 of the bar experiences tensile stresses. According to Hooke's Law, stress is directly proportional to the strain that is experienced when it is within the elastic range of the material. The proportionality constant is known as the modulus of elasticity and is dependent upon material and temperature. The strain experienced by the fibers across the thickness of a specimen depends upon the distance of a particular layer of fibers from the neutral surface.

Figure 2:
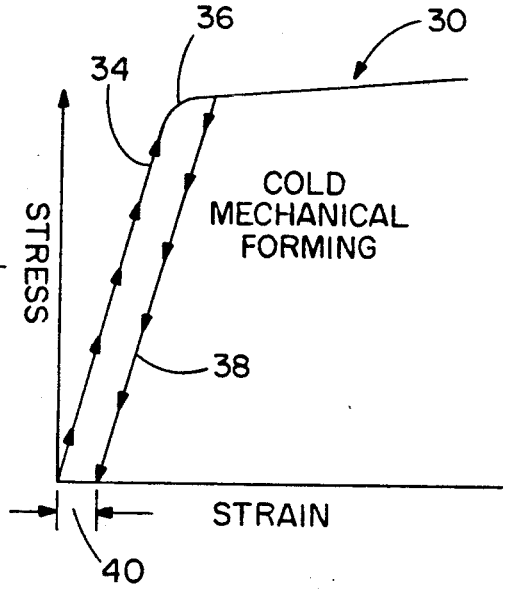
FIG. 2 is a stress-strain graph illustrating the relationship between stress and strain in the outermost layer of material of the bar of FIG. 1 during a cold mechanical forming process, depicting both the elastic range of the material and the deformation in the material after it has been stressed beyond the yield strength of the material.

If the stress induced throughout the bar stays within the elastic range of the material, the bar will return to its original flat configuration with no forming taking place once it is released. Therefore, if the bar is to retain a contour and be formed without the aid of thermal stress relaxation, a significant amount of fibers within the material must be stressed beyond their yield point. The stress-strain curve 30 in FIG. 2 can be used to examine the action involved in forming. The case of imparting a radius to a flat bar shaped part is not strictly a tensile application; rather it is one of bending. Therefore, in reality, the use of a stress-strain curve is only applicable to a single layer of material at a given distance from the neutral surface. Nevertheless, it serves the purpose of illustrating the differences between cold mechanical forming and age forming. For example, the stress-strain curve 30 in FIG. 2 illustrates cold mechanical forming of the bar 20 of FIG. 1 subjected to bending stresses.

Consider the outermost layer of material on what will become the convex side 28 of the bar. Initially the bar is flat and in a stress free state. As the bar is reconfigured to assume a radius, the fibers in the outside surface layer are strained which induces stress proportionally. This is illustrated by a stress distribution line 32 (FIG. 1) and by the linear portion 34 (FIG. 2) of the stress-strain curve beginning at the origin. The linear portion of the curve, which defines the modulus of elasticity, or Young's modulus, for the particular alloy of the bar 20, continues until the stress level reaches the yield strength 36 of the material. If the bar is released at any point prior to inducing a stress greater than the yield strength 36, it will unload along this same line and return to a flat (i.e., strain free) condition. Once a layer of material is stressed beyond its yield point; the relationship between stress and strain is no longer directly proportional (i.e., it is no longer linear). If at this point the bar is released, it will unload along a line 38 that has the same slope as the linear portion 34 of the load curve 30 but will be offset from the original load line 34 indicating a retained strain 40. The slope is equal to the modulus of elasticity as previously noted. The resulting retained strain 40, referred to as plastic strain, indicates that permanent deformation has taken place.

Figure 3:
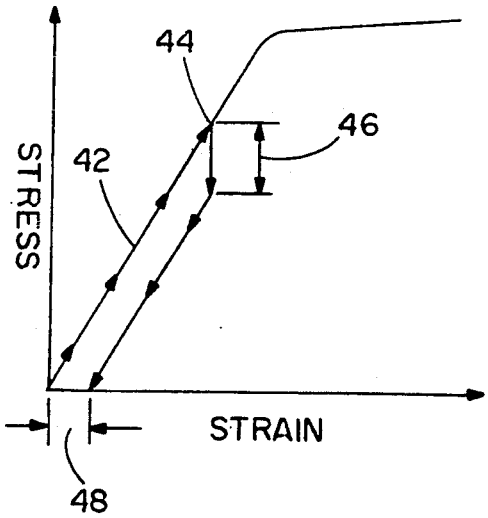
FIG. 3 illustrates a stress-strain graph, similar to FIG. 2, but indicating the result of an age forming process performed within the elastic range of the material.

Age forming forms a structure by taking advantage of the stress relaxation phenomena associated with artificial aging. The age forming concept is illustrated by the stress-strain curve in FIG. 3. Again, consider the outside layer of fibers on what will become the convex side of a formed member, such as convex side 28 of the bar 20 of FIG. 1. These fibers will experience tensile stresses. As the member is strained as indicated by a line 42 (FIG. 3), the stress level increases proportionally. Upon reaching a particular radius, the member is held at this constant strain level (as at point 44) and the artificial aging cycle is applied. Due to the metallurgical stress relaxation resulting from the materials' exposure to temperature, the stress level reduces even though the strain remains constant. The amount of stress relaxation that occurs, as indicated at 46, depends upon the material and its related aging temperature as well as the initial level of stress induced. The rate of stress relaxation is greatly enhanced by a higher initial stress level and by a higher aging temperature. However, these factors are limited by the temperature permitted by the selected aging cycle. Once the aging is complete, the member is cooled and released from its constraints. This allows the member to spring back and physically relax the remaining induced stress. Once again, an amount of strain 48 is retained by the member indicating permanent deformation. For the purpose of this discussion, the practice of age forming has been demonstrated within the elastic range of the material. It is in this region that the distinction between age forming and cold mechanical forming is most evident; however, the same principles apply within the plastic range (above yield) as well. In either the elastic or plastic range, age forming allows permanent deformation to be achieved with lower levels of applied stress than cold mechanical forming. Because of the way that cold mechanical forming works, residual stress levels within formed parts can be quite high. It is here that age forming presents significant advantages. First, the applied stress level required for forming is lower; and secondly, stress relaxation occurs during aging, lowering it even more while the part is held at a constant strain. After release from the forming tool, the age formed part relaxes the remaining induced stress, which is significantly lower than it was at the start of the aging cycle. The result is that the age formed part has the same permanent deformation as the mechanically formed part, but with much lower levels of residual stress.

The amount of stress relaxation experienced by a member during forming becomes the key to determining the amount of springback the member will experience following age forming. Predicting springback is the fundamental requirement to taking advantage of the age forming method. Knowledge of springback is needed to accurately determine forming tool contours.

Figure 4:
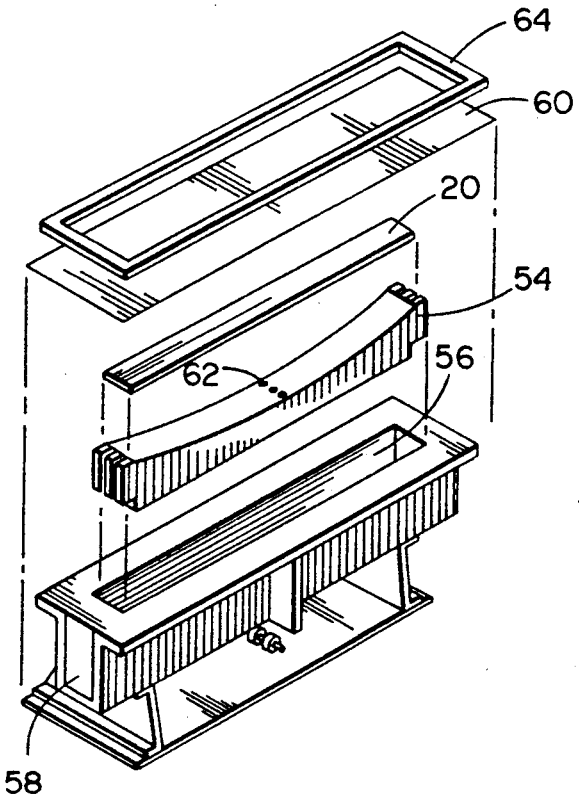
FIG. 4 is a perspective view, exploded, illustrating tooling for autoclave age forming a member such as the bar of FIG. 1.
Figure 5:
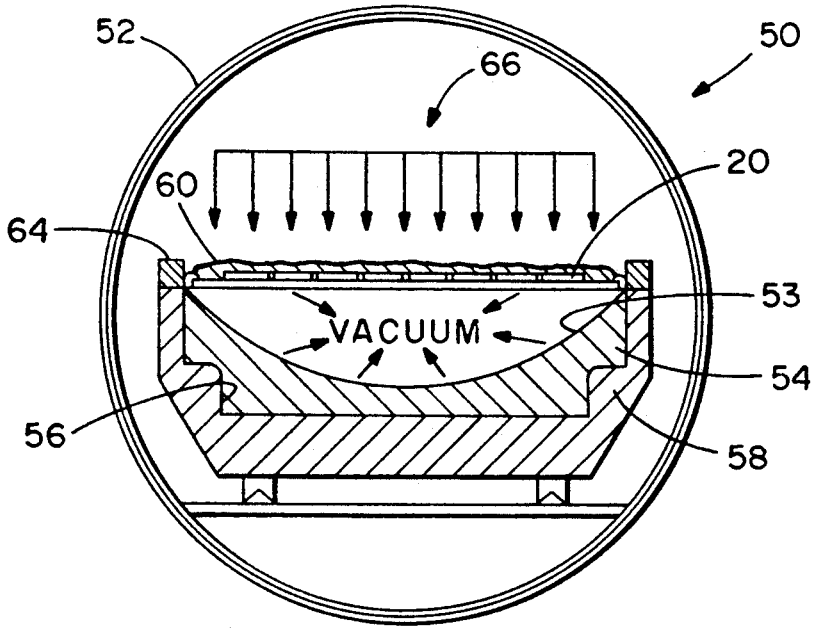
FIG. 5 is a detail cross section view illustrating the items shown in FIG. 4 within an autoclave.

For a brief initial explanation of the autoclave age forming process utilized for purposes of the invention, turn now to FIGS. 4 and 5. An autoclave 50 (FIG. 5) includes a generally thick-walled cylindrical vessel 52 which may typically be capable of withstanding pressures up to 200 psi, total vacuum, and temperatures up to 600° F. With this apparatus, as diagrammatically seen in FIG. 6, the part 20 is forced from an initial unformed condition (FIG. 6A) into intimate contact with the contoured surface 53 of a concave die 54 (FIG. 6B) receivable in a cavity 56 of an autoclave forming tool 58. This is accomplished by covering the top of the part 20, die 54, and forming tool cavity 56 with a temperature resistant vacuum blanket 60, sealing the edges of the blanket, drawing a vacuum through a plurality of vacuum ports 62 (FIG. 4) on the tool cavity beneath the part, and, if desired, also applying pressure to the upper surface of the part. A sealing frame 64 is removably mounted on the forming tool 58 to maintain the positioning of the vacuum blanket 60. The vacuum pulled underneath the part ensures that trapped air will not prevent it from obtaining total contact with the forming tool. The forming tool contour is designed to overform the part, allowing for springback. As noted above, pressure may be optionally applied to the part as indicated by arrows 66 to assure firm and continuous coextensive engagement of the die 54 by the part 20.

Figure 6A:
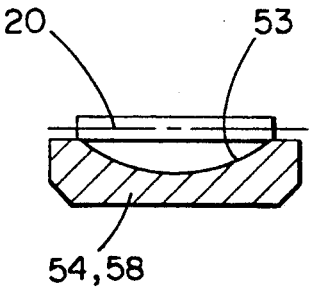
FIGS. 6A, 6B, 6C are successive diagrammatic detail end elevation views, partially in section, illustrating successive steps of the age forming method of the invention.
Figure 6B:
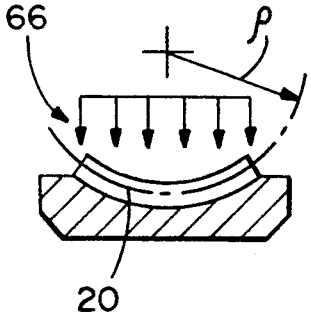
Figure 6C:
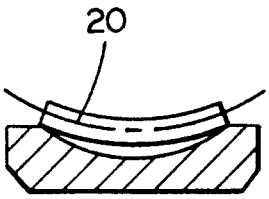

Up to this point, temperature has not been applied to the part, so that unless the bending stress applied has exceeded the yield point of the material, no permanent deformation has been achieved and the part is still within the elastic range of the stress strain diagram. This condition provides the most significant feature of age forming, since it can be performed at lower applied stress levels than conventional forming techniques. If the part were released from the vacuum and pressure holding it to the tool, it would essentially spring back to its initial flat condition (FIG. 6A). However, with the application of heat at appropriate temperatures for appropriate periods of time, the part will, after the forming process and after its release from the tool, spring back to an intermediate position as indicated in FIG. 6C.

The foregoing presents an early construction of an autoclave tool suitable for the process of the invention. However, it is not all inclusive. More recently, tools have been constructed with a skeleton framework of contoured boards covered by a contoured aluminum skin or caul plate. The pressure differential is created between the top of the panel and the caul sheet. The contour boards are not exposed to the pressure differential, except for those forces transmitted through the caul. A sealing frame is no longer employed to seal the vacuum bag to the tool. Instead, the vacuum seal is now maintained by adhesively attaching the bag to the surface of the caul with a temperature resistant putty. The newer tooling is simple, light-weight, and less costly to build. Nor does the tooling have to be concave; it can just as easily be convex. Also, production tools are not generally cylindrical, although individual contours are constructed of circular segments. While vacuum and pressure are preferably employed to obtain the appropriate applied strain, purely mechanical expedients, such as matched dies or clamps, may also be used. Much of the tooling is simply a function of the desire to use a pressure differential for forming. Age forming itself can be employed in both autoclaves and furnaces using both pressure and mechanical means. The method for developing the forming tool contour is the same, regardless of whether a pressurizd autoclave tool or a mechanically clamped furnace tool is desired. Springback is calculated as a function of the material, its thickness, and the final contour desired only. Regardless of whether age forming is performed in a furnace or autoclave, the material's response to aging remains the same.

Until the advent of the present invention, springback was defined as the difference between the chord height of the tool and the chord height of the formed specimen. However, it was found that this method was very restrictive and limited to predicting the springback of a constant thickness bar specimen formed to a radius. The old method was based purely on the percent change in chord height. The stress-strain curve was not used.

Figure 7:
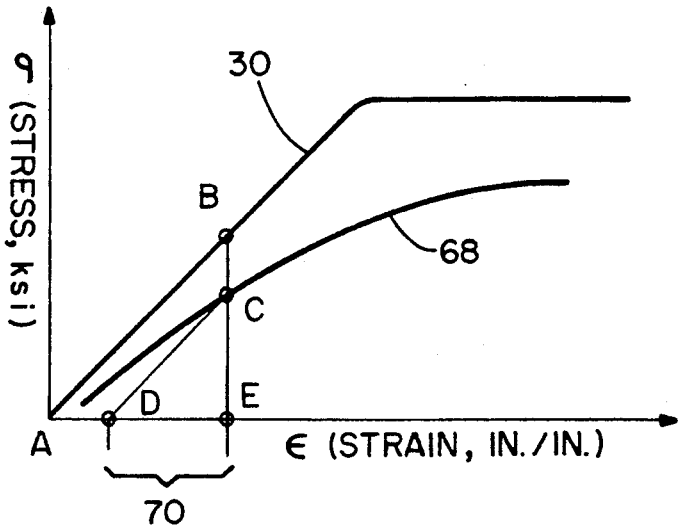
FIG. 7 is a graph which illustrates a stress-strain curve similar to that illustrated in FIG. 3 together with a stress relaxation curve which represents the stress relaxation experienced by bar specimens of different thicknesses when constrained to tools having different radii.

A new springback prediction method which forms the basis of the present invention is based upon the stress-strain curve, and has proven to be substantially more accurate than the previous prediction method. The new method defines springback more fundamentally as the elastic strain experienced by a specimen following the age forming process. When developing this new prediction method, the outside material layer of several formed specimens of various thicknesses conformed to various radii, and of a particular alloy, are considered. First, a conventional stress-strain curve 30 is developed from the specimens. Then, the action of the material of each specimen as it experiences age forming is plotted on a stress-strain diagram (FIG. 7). Once plotted, a curve 68 can be drawn through the points representing the stress level following the aging cycle but prior to each specimen's release from its constraints. This curve represents the stress relaxation experienced by bar specimens of various thicknesses when constrained to different radii. More importantly, the curve represents the stress relaxation experienced for increasing levels of applied strain. The bar specimens of various thicknesses constrained to tooling of different radii are merely one means of testing varying levels of strain through bending. It could just as easily be accomplished by subjecting specimens to axially applied tensile loads.

FIG. 7 illustrates broadly how this stress relaxation curve 68 is developed. The initial strain induced into a bar specimen 20 is calculated from the radius of the die 54 on the forming tool 58 and the thickness of the specimen. The applied strain is represented by point E in FIG. 7. The final or retained strain due to age forming is calculated in a similar manner based upon the final speciment radius and its thickness. The final strain is represented by point D in FIG. 7. Springback is represented by the elastic strain 70 which is the difference between the applied strain E and the final strain D. Specimens are age formed in a constant strain condition, that being the applied strain produced by the forming tool. The applied stress induced into the specimen can be found on an appropriate stress-strain curve by finding the stress value corresponding to the applied strain value. This is represented as point B in FIG. 7. The stress following the aging cycle can be calculated by knowing the slope of the line followed when the part is released from the tool. The slope is equivalent to the modulus of elasticity which depends upon the temperature just prior to being released from its constraints. Since the amount of retained strain is calculated from the specimen's final configuration, a line can be generated through the point of retained strain (point D in FIG. 7) with a slope of the modulus of elasticity. If this line is intersected with a vertical line passing through the applied strain value, the intersection point (point C in FIG. 7) represents the specimen after stress relaxation has taken place.

Therefore, by knowing the speciment thickness, the applied strain can be calculated from the tool radius and the retained strain can be calculated from the specimen's final radius. These two values, in conjunction with the modulus of elasticity, can be used to plot the point following stress relaxation. The stress relaxation curve can be generated by plotting the stress at the point of release for several thicknesses of specimens formed in different tool radii. Once the points are plotted, a curve 68 can be fit to the data using a least squares approximation. The key to the development of a stress relaxation curve lies in the fact that stresses built up within the part relax along the line of constant strain BCE (FIG. 7) during age forming. The line of constant strain relates to the strain applied in the forming tool. Upon release from the forming tool, the part unloads along a line to a strain value relating to the strain retained in the part as permanent deformation. The slope of the unloading line CD is equal to the modulus of elasticity of the material at the release temperature. The point at which the unloading line crosses the x axis, at which stress is zero, is the retained strain value. The intersection at C of the constant strain line BCE and the unloading line CD defines a point on the stress relaxation curve. Knowing the applied strain, AE, as calculated from the bar specimen thickness and forming tool radius, and the retained strain, AD, as calculated from the thickness and formed part radius, one can define a point C on the stress relaxation curve, (see FIG. 7). Each individual bar specimen yields a distinct point on the stress relaxation curve. After several bar speciment forming trials have been conducted, a series of data points are generated that can be used to construct a stress relaxation curve. Although the stress-strain curve 30 is shown in FIG. 7, it is not necessary for the construction of a stress relaxation curve 68.

Bar specimen data is used to construct a stress relaxation curve, and a typical procedure used will now be described. Rectangular bar specimens, 3 inches wide by 30 inches long, are produced in a range of thicknesses. These bar speciments are age formed in concave, cylindrical forming tools of 50, 150, and 300 inches in radius. Three specimens are produced from each thickness tested. The three specimens produced correspond to the three forming tool radii that are used in the forming trials. Each specimen results in a specific combination of thickness, tool radius, and formed part radius. By testing a range of thicknesses and tooling radii, a series of these combinations is developed.

For each speciment tested, the thickness and tool radius are used to calculate an applied strain, while the thickness and formed part radius are used to calculate a retained strain. This is accomplished in the following manner.

The tool radius, $\rho_{tool}$, and specimen thickness, t, can be used to calculate the strain that occurs when the specimen assumes the radius of the forming tool, referred to as the applied strain, $\epsilon_{applied}$. The variation of the bending strain through the depth of a beam can be obtained via the equation:

$$\epsilon_x = -\frac{y}{\rho}$$

where $\rho$ is the radius of curvature (FIG. 6B) of the neutral surface coinciding with the deformed centroidal line and y is the distance from the neutral surface to the point at which the strain is occurring (FIG. 1). The equation for the strain distribution has been developed via geometric asumptions and is, therefore, independent of material behavior. The equation and its development have been taken from "Mechanics of Materials" by Nelson R. Bauld, Jr., Brooks/Cole Engineering Division, Belmont, Calif., 1982, pp. 187–189.

Figure 8:
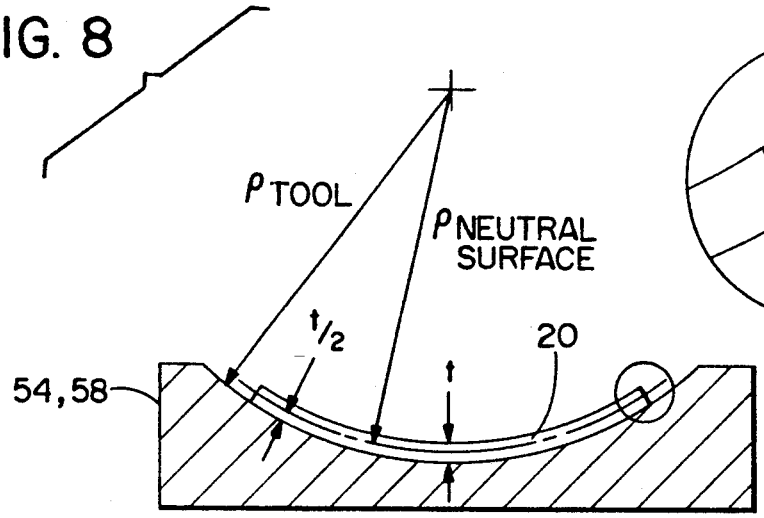
FIGS. 8 and 8A are a cross sectional diagrammatic view illustrating a bar specimen in intimate contact with a forming tool.
Figure 8A:
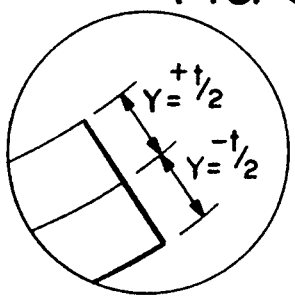

For the instant situation, viewing FIG. 8, the tool radius, $\rho_{tool}$ can be related to the neutral surface of the bar specimen. Two factors allow the assumption that the neutral surface will coincide with the horizontal plane of symmetry. First, the bar specimen has a rectangular cross section, and therefore both a horizontal and vertical plane of symmetry. Second, the tensile and compressive stress-strain curves are very similar for the aluminum alloys used in age forming. With this in mind, the neutral surface of the bar specimen is assured to lie within the center of the rectangular cross section. When the bar is in intimate contact with the surface of the forming tool, the forming tool radius, $\rho_{tool}$, can be used to determine the radius of the neutral surface, $\rho_{neutral\ surface}$, of the cross section. The following equation is for the case of a bar specimen in a concave tool.

$$\rho_{neutral\ surface} = \rho_{tool} - \frac{t}{2},$$

where t is the cross sectional thickness.

It is the strain occurring in the outermost fibers of the cross section that are of interest. Therefore, the displacement from the neutral surface y is equal to one-half of the specimen thickness, t/2. Substituting these latest relationships for displacement y and neutral surface radius $\rho$ into the strain distribution equation yields the following expression for the strain applied by the forming tool:

$$\epsilon_{applied} = -\frac{y}{\rho} = \frac{-t/2}{\rho_{tool} - t/2}$$

The minus sign denotes the compressive strains that occur on the inner or concave side of the specimen. Of primary interest for purposes of the invention is the convex side of the specimen which experiences tensile strains and is located at a distance of $-t/2$ from the neutral surface. This is depicted in FIG. 8.

Therefore, for the tensile side of the specimen, the applied strain can be determined using the equation:

$$\epsilon_{applied} = \frac{-(-t/2)}{\rho_{tool} - t/2} = \frac{t/2}{\rho_{tool} - t/2} = \frac{t}{2\rho_{tool} - t}$$

The same relationship can be used to determine the strain retained in the specimen in the form of plastic deformation. In this case, the outer or convex radius of the formed specimen, $\rho_{formed\ part}$, is substituted for the tool radius $\rho_{tool}$ to obtain the following expression:

$$\epsilon_{retained} = \frac{-(-t/2)}{\rho_{formed\ part} - t/2} = \frac{t}{2\rho_{formed\ part} - t}$$

The radius of the specimen must be measured at the outer or convex side of the specimen, in order for this expression to be valid.

Knowing the applied and retained strains allows a stress relaxation curve to be constructed. As mentioned earlier, the results of each forming trial represent one point on the stress relaxation curve. On a stress-strain diagram, as noted earlier, the applied strain defines a vertical line of constant strain stress relaxation, specifically, line BCE in FIG. 7. The applied strain represents the strain induced by the forming tool. The retained strain point D in FIG. 7, represents the stain value for which the unloading line CD crosses the x axis and reflects zero stress. The slope of the unloading line is equal to the modulus of elasticity of the material at the unloading temperature. The unloading line is defined by the equation:

$$y = mx + b$$

where $y = \sigma$ = stress $m = E$ = modulus at temp.

$b = y$ − intercept $x = \epsilon$ = strain.

Rewritten in terms of stress and strain, the equation takes the form: $\sigma = E\epsilon + b$.

At this point, knowing the slope of the unloading line CD and knowing a retained strain value E, enables a point on the unloading line to be defined. The point-slope form can now be used to generate an equation for the unloading line. The point-slope form looks like this: $(y - y^*) = m(x - x^*)$, where $(x^*, y^*)$ is any point on the line and m is the slope.

In the present instance, $m = E$ and $(x^*, y^*) = (\epsilon_{retained}, 0)$. Substituting these values into the point-slope equation and solving first for y, yields:

$$y = m(x - x^*) + y^* \text{ where } y = \sigma,\ x = \epsilon$$
$$m = E,\ x^* = \epsilon_{retained},\ y^* = 0$$

Then, solving for $\sigma$, the unloading line equation is obtained:

$$\sigma = E(\epsilon - \epsilon_{retained}).$$

The unloading line equation can now be used to determine the stress at which the unloading line and constant strain line cross. This intersection represents the point at which the specimen is released from the forming tool and is allowed to spring back, that is, relax along the unloading line to a point of zero stress. The intersection point also serves as a point on the stress relaxation curve. Substituting the applied strain value into the equation gives:

$$\sigma = E(\epsilon_{applied} - \epsilon_{retained}).$$

It is significant to note that the term $(\epsilon_{applied} - \epsilon_{retained})$ represents the change in strain that occurs during springback. This change in strain has been called the elastic strain or $\epsilon_{elastic}$. It is this portion of the applied strain that is lost during unloading and is referred to as springback.

It is important to note that the unloading line is dependent upon the modulus of elasticity; therefore, it is temperature dependent. During forming trials all specimens should be cooled to the same temperature before being released from restraint and allowed to spring back. The foregoing expression developed for the unloading line is valid for both elastic and inelastic material behavior.

Figure 9:
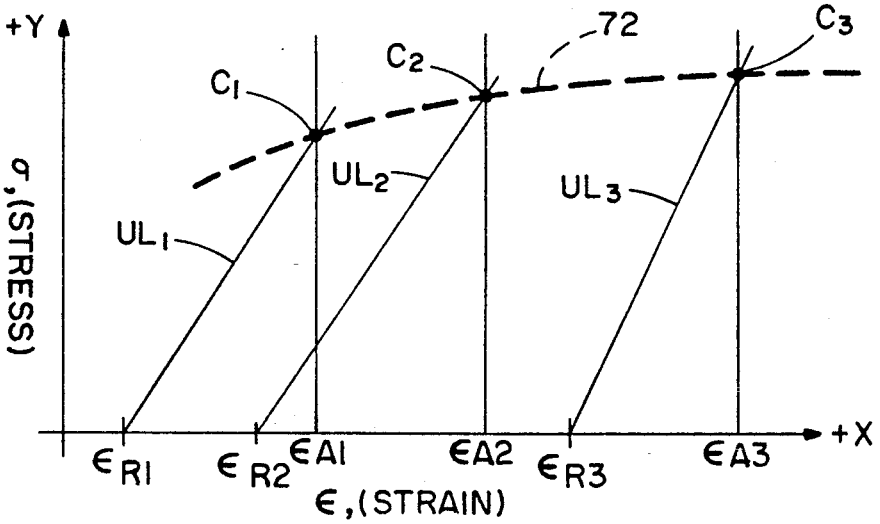
FIG. 9 is a graph illustrating the development of a stress relaxation curve.

Now, the applied strain, retained strain, and modulus of elasticity can all be used to define a point on a stress relaxation curve. A range of applied strains $\epsilon_{A1}, \epsilon_{A2}, \epsilon_{A3} \ldots \epsilon_{An}$ and retained strains $\epsilon_{R1}, \epsilon_{R2}, \epsilon_{R3} \ldots \epsilon_{Rn}$, as generated by bar forming trials, can be used with their associated unload lines $UL_1, UL_2, UL_3 \ldots UL_n$ to define a succession of points, $C_1, C_2, C_3 \ldots C_n$ and thereby construct a stress relaxation curve 72, as depicted in FIG. 9. To simplify the calculations involved in determining points along the stress relaxation curve, the unloading line equation can be normalized by dividing each side by the modulus to obtain:

$$\frac{\sigma}{E} = (\epsilon_{applied} - \epsilon_{retained}) = \epsilon_{elastic}.$$

This normalization allows the slope of the unloading line to be equal to one. Each point can now be defined in terms of the applied strain, which is its x component, and the elastic strain which is its y component. Successive points can be defined in this manner and plotted as shown. With this method, it is not necessary to know the exact modulus as long as all bar specimens are released at the same temperature. Such a normalized stress relaxation curve is indicated by reference numeral 74 in FIG. 10.

The data points can also be used to determine a polynominal equation which, in effect, is a curve fit equation. For a second order curve fit, the equation would generally be in the form: $y = Ax^2 + Bx + C$ where A, B, and C are constants, y is the normalized stress $\sigma/E$ and x is the applied strain $(\epsilon_{applied})$. From the earlier development, it can be shown that the normalized stress $\sigma/E$ is equal to the elastic strain $(\epsilon_{elastic})$. It is this curve fit equation that is used to represent the normalized stress relaxation curve.

Once a normalized stress relaxation curve has been established, it can be used to predict springback and in the development of forming tool contours. The retained strain, as it applies to the desired formed contour, is generally known or can be calculated. For the purpose of this discussion a normalized stress relaxation curve will be used, although a "regular" stress relaxation curve could be used. The retained strain ($\epsilon_{retained}$) defines a point on the x axis for which the normalized stress $\sigma/E$ is zero. The unloading line passes through this point and since a normalized stress relaxation curve is being used, its slope is equal to one. As noted earlier, the equation of this line is: $\sigma/E=(\epsilon-\epsilon_{retained})$.

The equation for the normalized stress relaxation curve has also been previously determined and is of the form: $\sigma/E=A\epsilon^2+B\epsilon+C$.

The intersection of the unloading line and the normalized stress relaxation curve corresponds to the applied strain that the forming tool should be designed to apply. At the intersection point, the unloading line equation and the stress relaxation curve equations are equal. This expression can be written as:

$$\sigma/E=\epsilon-\epsilon_{retained}=A\epsilon^2+B\epsilon+C.$$

Since the stress relaxation curve was expressed as a second order equation, the combined equations take the form of:

$$A\epsilon^2+(B-1)\epsilon+(C+\epsilon_{retained})=0$$

wherein A, B, and C are known constants and $\epsilon_{retained}$ is also a known quantity. The quadratic formula can be used to solve for the roots ($\epsilon_1^*$, $\epsilon_2^*$) of the resulting equation, as it is of the form $Ax^2+Bx+C=0$, and the constants (A, B, and C) are known. The quadratic formula is expressed as:

$$\epsilon_1^*,\epsilon_2^* = \frac{-B \pm \sqrt{B^2-4AC}}{2A}$$

In practice, one of the roots is usually negative and is therefore disregarded. The remaining root is the applied strain value that is desired.

The quadratic formula thus is a convenient means for determining the roots when a second order equation is used to represent the stress relaxation data. If a higher order polynominal had been used, a numerical analysis technique could have been used to determine the roots. The method also lends itself to graphical techniques.

The foregoing methodology is first employed for one given location on the tool. This methodology is then performed over and over again until the desired number of locations, possibly hundreds or thousands, have been plotted to provide a satisfactory contour.

Figure 11:
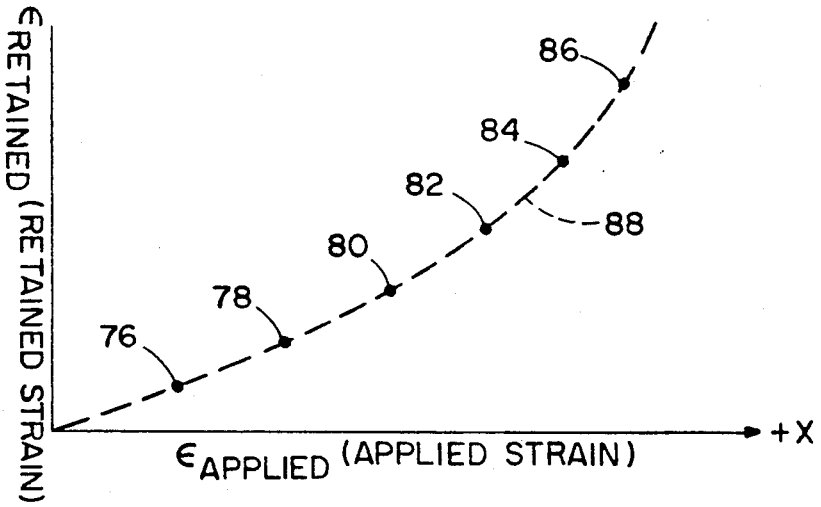
FIG. 11 is a graph illustrating the development of a strain retention (retained strain versus applied strain) curve.

The initial strain to be applied in a forming tool to achieve a desired final shape in a part can also be determined from a strain retention curve which is based upon the relationship between the applied and retained strain values for a series of bar specimens. Each bar specimen formed yields a combination of applied strain and retained strain which is represented as a single point on the graph depicted in FIG. 11. Each of the data points successively indicated as 76, 78, 80, 82, 84, 86 and defining a strain retention curve 88, is then used to determine a polynomial equation. For a second order curve fit, the equation would generally be in the form as noted earlier: $y=Jx^2+Kx+L$ where J, K, and L are constants, y is the retained strain ($\epsilon_{retained}$), and x is the applied strain ($\epsilon_{applied}$). The strain retention curve relates the amount of strain retained in the bar specimen, in the form of plastic deformation, to the strain applied in the forming tool.

Figure 12:
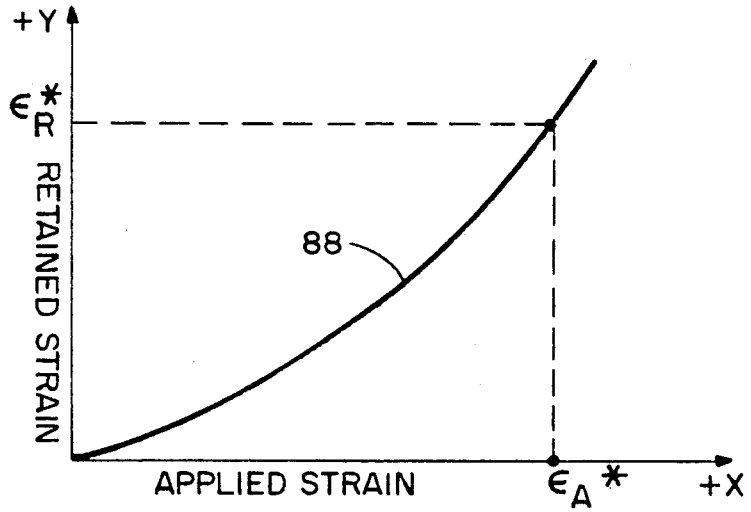
FIG. 12 is a graph illustrating the application of the strain retention curve to obtain a desired solution.

Once a strain retention curve has been established, it can be used to predict springback and in the development of forming tool contours. There are two methods for using the strain retention curve. In a first method, the retained strain ($\epsilon_R^*$), as it applies to the desired formed contour, is generally known or can be calculated. The retained strain ($\epsilon_R^*$) defines a horizontal line that intersects the strain retention curve at an x value that is equal to the applied strain ($\epsilon_A^*$) which the forming tool should be designed to apply. See FIG. 12.

The equation of the retained strain line is: $y=\epsilon_R^*$. The equation of the strain retention curve is $y=Jx^2+Kx+L$. At the intersection point, the horizontal retained strain line and the strain retention curve are equal. This relationship can be written as: $y=\epsilon_R^*=Jx^2+Kx+L$ or $\epsilon_R^*=Jx^2+Kx+L$.

Combining like terms and setting the expression equal to zero yields: $Jx^2+Kx+(L-\epsilon_R^*)=0$, where J, K, L, and $\epsilon_R^*$ are constants and x is in terms of applied strain. The quadratic formual or some numerical method can be used to solve for the roots of the combined equations. In general, only one of the roots will make sense in the given context, so that the other can be disregarded. It is this root that represents the applied strain ($\epsilon_A^*$) and is the desired value.

Figure 13:
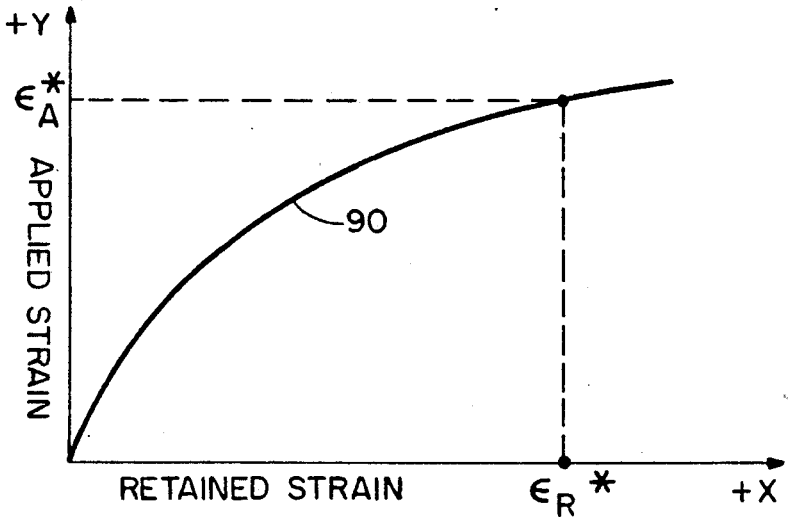
FIG. 13 is a graph of a strain retention curve using a different method than for the curves of FIGS. 11 and 12.

A second method for using the strain retention data is somewhat more straightforward than the first. The strain retention curve 90 (FIG. 13) of this method is created differently, in that the axes are reversed. A curve fit of the bar specimen data, applied and retained strains, is used to generate an equation of the form $y=Px^2+Qx+R$, where y is the applied strain ($\epsilon_{applied}$), x is the retained strain ($\epsilon_{retained}$), and P, Q, and R are constants. The curve fit is performed in this manner. The required contour, and therefore retained strain, is generally a known value, the unknown to be determined being the tooling contour or applied strain.

In this instance, the strain retention curve equation can be used to solve for the applied strain, $\epsilon_A^*$, directly. The retained strain value, $\epsilon_R$, which is known, is introduced into the polynomial equation and used to solve for the applied strain, $\epsilon_A^*$.

Because curve fits were used to define the strain retention curves in each of the strain retention methods, the two methods will not yield exactly the same applied strain, $\epsilon_A^*$, for a given retained strain, $\epsilon_R^*$. It is easiest to relate the first method discussed to the earlier presented stress relaxation methodology as will now be related.

Both the stress relaxation and the strain retention methods are developed using the same starting data. From the bar specimen tests, a series of data points of the form ($\epsilon_{applied}$, $\epsilon_{retained}$) are developed. The strain retention method uses this data directly and a polynomial equation is developed of the form $\epsilon_{retained}=P\epsilon_{applied}^2+Q\epsilon_{applied}+R$. Plotted, this equation takes the form depicted in FIG. 11. For the stress relaxation method, the data points are rearranged using the relationship $\epsilon_{elastic}=\epsilon_{applied}-\epsilon_{retained}$ so that the basic data is transformed to be of the form: ($\epsilon_{applied}$, $\epsilon_{elastic}$) and a polynomial is developed of the form:

$$\sigma/E=\epsilon_{elastic}=A\epsilon_{applied}^2+B\epsilon_{applied}+C.$$

Figure 10:
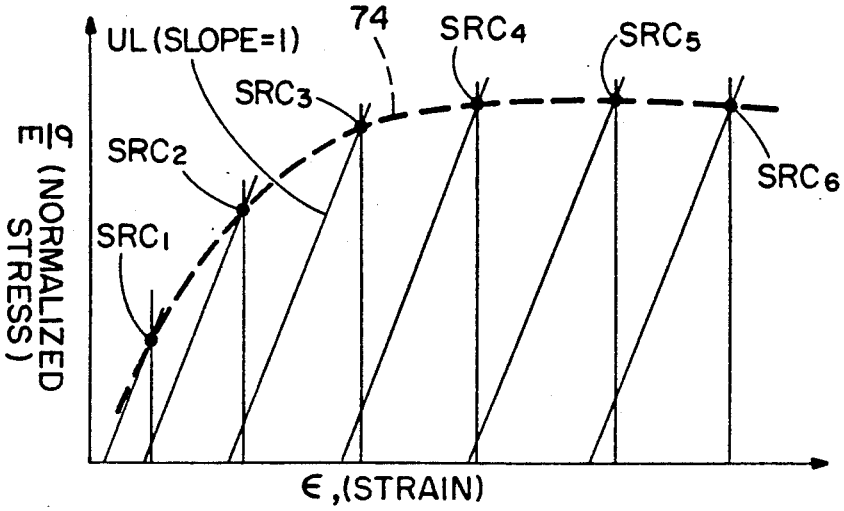
FIG. 10 is a graph illustrating the development of a normalized stress relaxation curve.

Plotted, this equation takes the form depicted in FIG. 10. It has been previously developed that the normalized stress $\sigma/E=\epsilon_{elastic}$.

Figure 14:
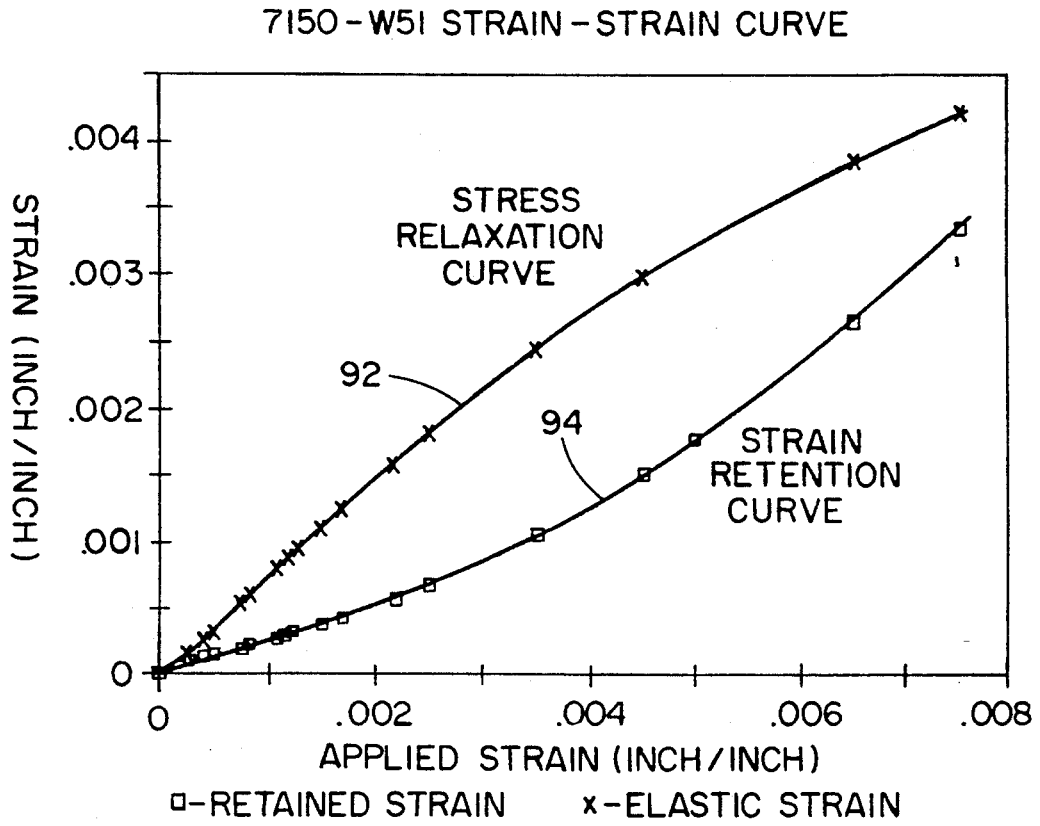
FIG. 14 is a graph presenting actual stress relaxation and strain retention curves for aluminum alloy 7150-W51 aged to T651.

Now, since $\epsilon_{retained}$ and $\epsilon_{elastic}$ are both dimensionless terms, both the stress relaxation and strain retention curves can be plotted on the same graph. See FIG. 14 which shows actual stress relaxation and strain retention curves for aluminum alloy 7150-W51 aged to T651. The 7150 bar data resulting from an actual test and from which the curves 92 and 94 in FIG. 14 have been developed is presented in Table 1.

TABLE 1

| 7510 W51-7541 PLATE | PART THICKNESS (INCHES) | TOOL RADIUS (INCHES) | PART RADIUS (INCHES) | APPLIED STRAIN (IN/IN) | RETAINED STRAIN (IN/IN) | ELASTIC STRAIN (IN/IN) |
|---|---|---|---|---|---|---|
| | 0.150 | 50.00 | 199.66 | 0.00150 | 0.00038 | 0.00113 |
| | 0.150 | 50.00 | 204.19 | 0.00150 | 0.00037 | 0.00113 |
| | 0.150 | 150.00 | 600.86 | 0.00050 | 0.00012 | 0.00038 |
| | 0.150 | 150.00 | 590.49 | 0.00050 | 0.00013 | 0.00037 |
| | 0.150 | 300.00 | 1177.74 | 0.00025 | 0.00006 | 0.00019 |
| | 0.150 | 300.00 | 1160.15 | 0.00025 | 0.00006 | 0.00019 |
| | 0.253 | 50.00 | 196.56 | 0.00254 | 0.00064 | 0.00189 |
| | 0.250 | 50.00 | 190.45 | 0.00251 | 0.00066 | 0.00185 |
| | 0.252 | 150.00 | 635.12 | 0.00084 | 0.00020 | 0.00064 |
| | 0.250 | 150.00 | 682.25 | 0.00083 | 0.00018 | 0.00065 |
| | 0.252 | 300.00 | 1589.24 | 0.00042 | 0.00008 | 0.00034 |
| | 0.250 | 300.00 | 1640.95 | 0.00042 | 0.00008 | 0.00034 |
| | 0.350 | 50.00 | 171.15 | 0.00351 | 0.00102 | 0.00249 |
| | 0.350 | 50.00 | 179.74 | 0.00351 | 0.00097 | 0.00254 |
| | 0.350 | 150.00 | 766.72 | 0.00117 | 0.00023 | 0.00094 |
| | 0.349 | 150.00 | 641.44 | 0.00116 | 0.00027 | 0.00089 |
| | 0.350 | 300.00 | 3053.76 | 0.00058 | 0.00006 | 0.00053 |
| | 0.349 | 300.00 | 3449.39 | 0.00058 | 0.00005 | 0.00053 |
| | 0.448 | 50.00 | 148.59 | 0.00450 | 0.00151 | 0.00299 |
| | 0.448 | 50.00 | 148.49 | 0.00450 | 0.00151 | 0.00299 |
| | 0.449 | 150.00 | 493.10 | 0.00150 | 0.00046 | 0.00104 |
| | 0.448 | 150.00 | 468.72 | 0.00150 | 0.00048 | 0.00102 |
| | 0.449 | 300.00 | 740.47 | 0.00075 | 0.00030 | 0.00045 |
| | 0.448 | 300.00 | 838.81 | 0.00075 | 0.00027 | 0.00048 |
| | 0.505 | 50.00 | 149.67 | 0.00508 | 0.00169 | 0.00339 |
| | 0.504 | 50.00 | 153.30 | 0.00507 | 0.00165 | 0.00342 |
| | 0.504 | 150.00 | 565.05 | 0.00168 | 0.00045 | 0.00124 |
| | 0.505 | 150.00 | 576.31 | 0.00169 | 0.00044 | 0.00125 |
| | 0.503 | 300.00 | 1117.81 | 0.00084 | 0.00023 | 0.00061 |
| | 0.504 | 300.00 | 1155.66 | 0.00084 | 0.00022 | 0.00062 |
| | 0.654 | 50.00 | 123.63 | 0.00658 | 0.00265 | 0.00393 |
| | 0.650 | 50.00 | 122.56 | 0.00654 | 0.00266 | 0.00388 |
| | 0.654 | 150.00 | 530.75 | 0.00218 | 0.00062 | 0.00157 |
| | 0.650 | 150.00 | 452.57 | 0.00217 | 0.00072 | 0.00145 |
| | 0.656 | 300.00 | 908.86 | 0.00109 | 0.00036 | 0.00073 |
| | 0.650 | 300.00 | 898.13 | 0.00108 | 0.00036 | 0.00072 |
| | 0.750 | 50.00 | 109.05 | 0.00756 | 0.00345 | 0.00411 |
| | 0.736 | 50.00 | 110.90 | 0.00741 | 0.00333 | 0.00409 |
| | 0.750 | 150.00 | 527.65 | 0.00251 | 0.00071 | 0.00180 |
| | 0.744 | 150.00 | 503.46 | 0.00249 | 0.00074 | 0.00175 |
| | 0.750 | 300.00 | 1100.20 | 0.00125 | 0.00034 | 0.00091 |
| | 0.735 | 300.00 | 1048.04 | 0.00123 | 0.00035 | 0.00088 |

The relationship between the two methods can be presented as follows:

| Curve | Basic Data Form | Equation Form |
|---|---|---|
| Strain Retention | $(\epsilon_{applied}, \epsilon_{retained})$ | $\epsilon_{retained}=P\epsilon_{applied}^2+Q\epsilon_{applied}+R$ |
| Stress Relaxation | $(\epsilon_{applied}, \epsilon_{applied}-\epsilon_{retained})$ or $(\epsilon_{applied}, \epsilon_{elastic})$ | $\epsilon_{elastic}=A\epsilon_{applied}^2+B\epsilon_{applied}+C$ |

Figure 15:
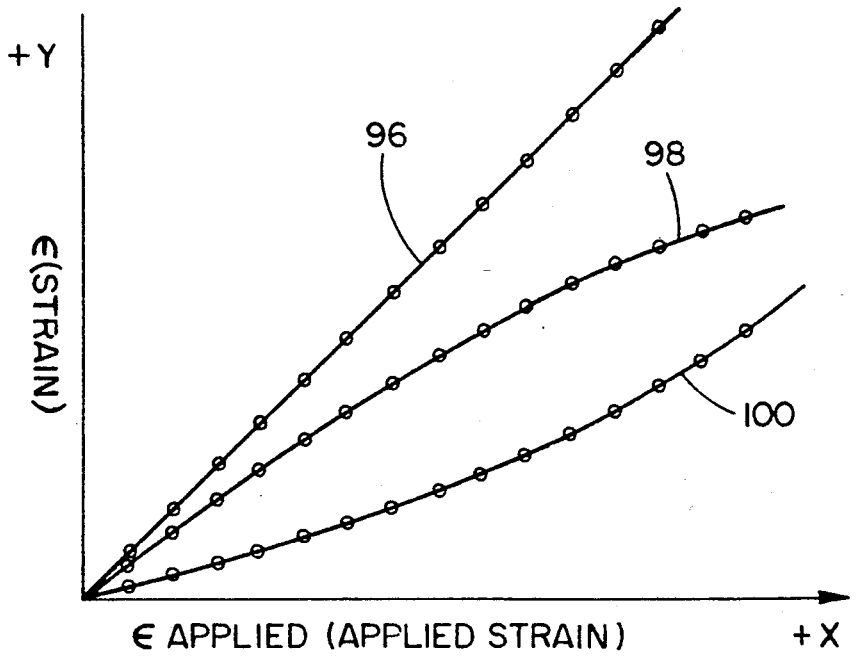
FIG. 15 is a graph presenting curves of applied strain, retained strain, and stress relaxation (i.e.: applied minus retained stress)

In order to illustrate the relationship between the applied, retained, and elastic strains, the applied strain is plotted as a function of itself (i.e. $\epsilon_{applied}$, $\epsilon_{applied}$). With the stress relaxation and strain retention curves simultaneously presented, the resulting plot would appear as shown in FIG. 15. In FIG. 15, line 96 is a line representing applied strain, curve 98 is a stress relaxation curve representing elastic strain, and curve 100 is a strain retention curve representing retained strain. Each individual data point on the stress relaxation curve 98 is a combination of $(\epsilon_{applied}, \epsilon_{elastic})$ where $\epsilon_{elastic}=\epsilon_{applied}-\epsilon_{retained}$. Each individual data point on the strain retention curve 100 is a combination of $(\epsilon_{applied}, \epsilon_{retained})$.

The only meaningful difference between using the two methods therefore depends on whether one chooses to use the data in the form $(\epsilon_{applied}, \epsilon_{retained})$ or $(\epsilon_{applied}, \epsilon_{elastic})$.

Now, turn to the bar specimen data of Table 1 obtained from aging 7150-W51 to the T651 temper and compare the two methods. Let it be assumed that there is an application for 7150-T651 and that for a specific station, the combination of required contour and panel thickness provides a retained strain $(\epsilon_{retained})$ value of 0.002 in/in.

Using the stress relaxation method and performing a second order polynomial curve fit on the 7150 bar specimen data, in the form $(\epsilon_{applied}, \epsilon_{elastic})$ yields the following equation:

$$\epsilon_{elastic}=-37.56002\,(\epsilon_{applied})^2+0.8487542\,(\epsilon_{applied})-0.000066781,$$

or $$y=-37.56002x^2+0.8487542x-0.000066781$$

where the constants A, B, and C can be determined by a mathematical technique such as a least squares curve fit. The unloading line that crosses the x-axis at a strain of 0.002 in/in and has a slope of 1, can be represented by the equation:

$$\epsilon_{elastic}=\epsilon_{applied}-0.002$$

or $$y=x-0.002.$$

Since the two equations will be equal at their intersection point, we can set them equal and write the following expression:

$$x-0.002=-37.56002x^2+0.8487542x-0.000066781.$$

Combining like terms and setting the equations equal to 0 yields:

$$37.56002x^2+0.15124580x-0.001933=0.$$

Solving for the roots of this quadratic equation yields:

$$r_1=0.00543736;$$

$$r_2=-0.00946414.$$

Being a negative value, $r_2$ is eliminated.

Root $r_1$ corresponds to the applied strain that will result in a retained strain of 0.002. Therefore, $\epsilon_{applied}=0.00544$.

Using the strain retention method and performing a second order polynomial curve fit on the 7150 bar specimen data, in the form ($\epsilon_{applied}$, $\epsilon_{retained}$) yields the following equation:

$$\epsilon_{retained}=37.60952\ \epsilon_{applied}^2+0.1509891\ \epsilon_{applied}+0.000066281,$$

or $$y=37.60952\ x^2+0.1509891\ x+0.000066281.$$

The point being sought is that point at which the strain retention curve crosses the line representing a retained strain of 0.002 in/in, which has the equation y=0.002.

Again, setting the two expressions equal, combining like terms, and setting the resulting quadratic expression equal to zero yields:

$$37.60952\ x^2+0.1509891\ x-0.00193372=0.$$

Solving for the roots of this quadratic equation yields:

$$r_1=0.00543911;$$

being a negative value, $r_2$ is eliminated.

Root $r_1$ corresponds to the applied strain that will result in a retained strain of 0.002.

Therefore, $\epsilon_{applied}=0.00544$ in/in.

As shown, both methods predict an applied strain value of 0.00544 in/in for a retained strain requirement of 0.00200 in/in.

For deciding whether to use the stress relaxation method or the strain retention method, consider the following. The stress relaxation method is the preferred method for developing forming tool contour when the data needed lies outside of the applied strain range tested. In developing a stress relaxation curve, a finite number of bar forming trials are conducted. A curve fit is performed upon the bar data (applied and retained strains). This curve fit becomes the stress relaxation curve. The accuracy of the stress relaxation curve is limited to the range of the test data that was used to create it. Because the stress relaxation curve can be directly compared to the stress strain curve, for the alloy in question, a degree of confidence can be established with regard to the extrapolated values. Being able to compare the extrapolated values to the stress strain curve allows one to establish a degree of confidence and thereby decide whether additional bar specimen tests need to be conducted to better define the area in question. The stress strain curve provides a "reality check."

The strain retention method is not advised for values that lie outside of the data range tested. The strain retention method requires less calculation and uses the data directly in the applied strain-retained strain form. In this case, the strain retention method is a "short cut".

When the required strain values lie within the range of the test data, it is purely a matter of personal choice as to which method to use. It has been shown that both methods yield the same predictions when the required value lies within the range of the test data used to produce the stress relaxation and strain retention curves.

Figure 16A:
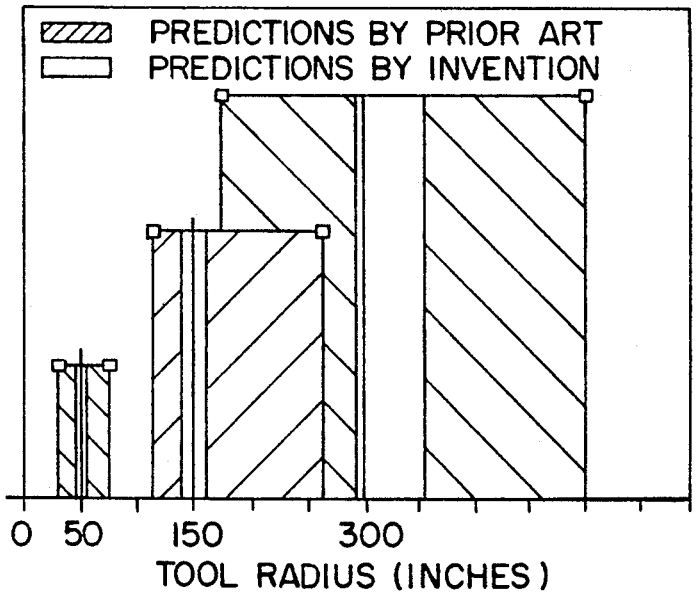
FIGS. 16A and 16B are bar graphs which compare the tool contour prediction method of the invention as compared to that of the prior art.
Figure 16B:
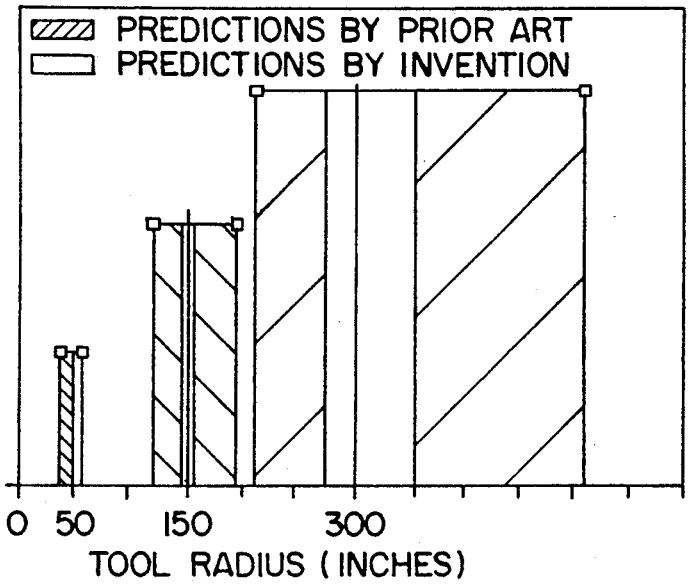

A comparison of the results of the trial and error prediction method previously used without benefit of the relationships provided by the stress relaxation curve or by the strain retention curve and the results obtained as a result of the present invention are shown in bar graph form in FIGS. 16*a* and 16*b*, the former for alloy 2024, the latter for alloy 7075. Each method should have predicted tool radii of 50 inches, 150 inches, and 300 inches. The range of the actual predictions are shown by the width of the bars on the bar graph. The method of the invention shows a significant reduction in the amount of erroneous predictions produced over those produced by the trial and error method previously used.

Figure 17:
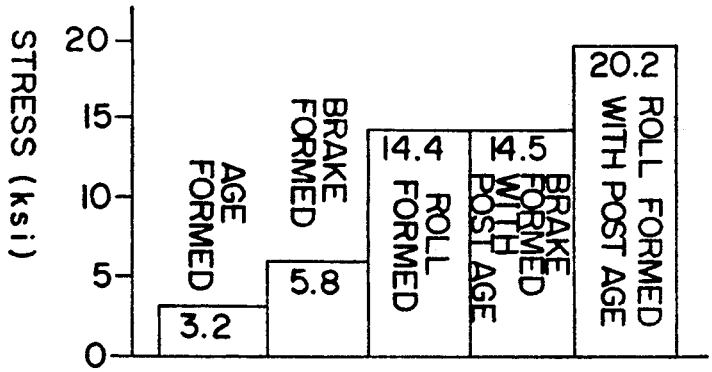
FIG. 17 is a bar graph which indicates residual stress levels of autoclave age formed specimens when compared to levels found in specimens formed by other means.

An added benefit of the invention was discovered when the residual stress levels of age formed specimens were compared to levels found in specimens formed by other means. As seen in FIG. 17 for the aluminum alloy 7075, the test results clearly demonstrated that the age formed specimen had lower residual stresses than identical specimens formed by other forming methods. In fact, the residual stresses in the age formed specimen were actually lower than those in the unformed control specimen. This result indicates that there is stress relaxation occurring during the age forming cycle, serving even to relax stresses already present in the plate material prior to forming.

Figure 23A:
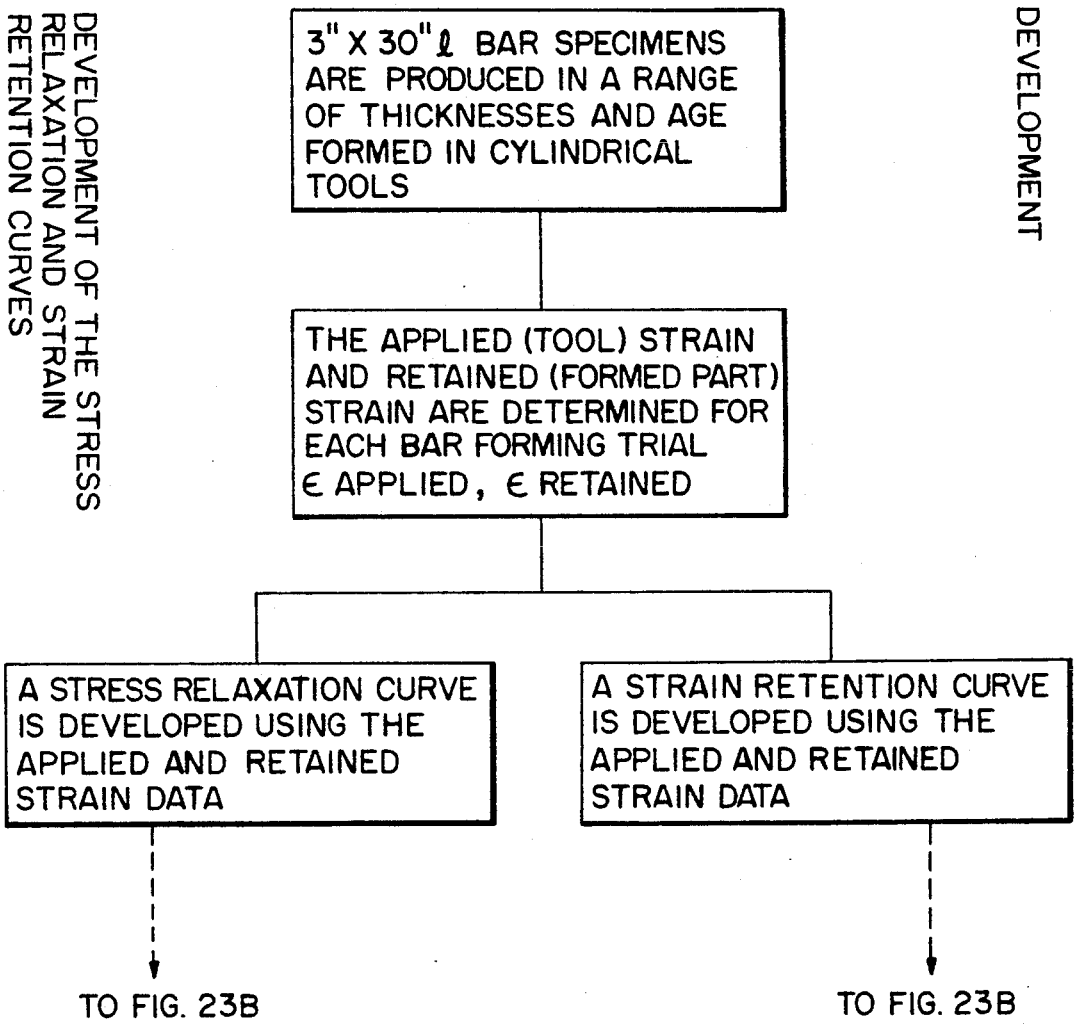
FIGS. 23A and 23B are a process flow chart presenting the two major processes of the invention used for developing the contour of a forming tool.
Figure 23B:
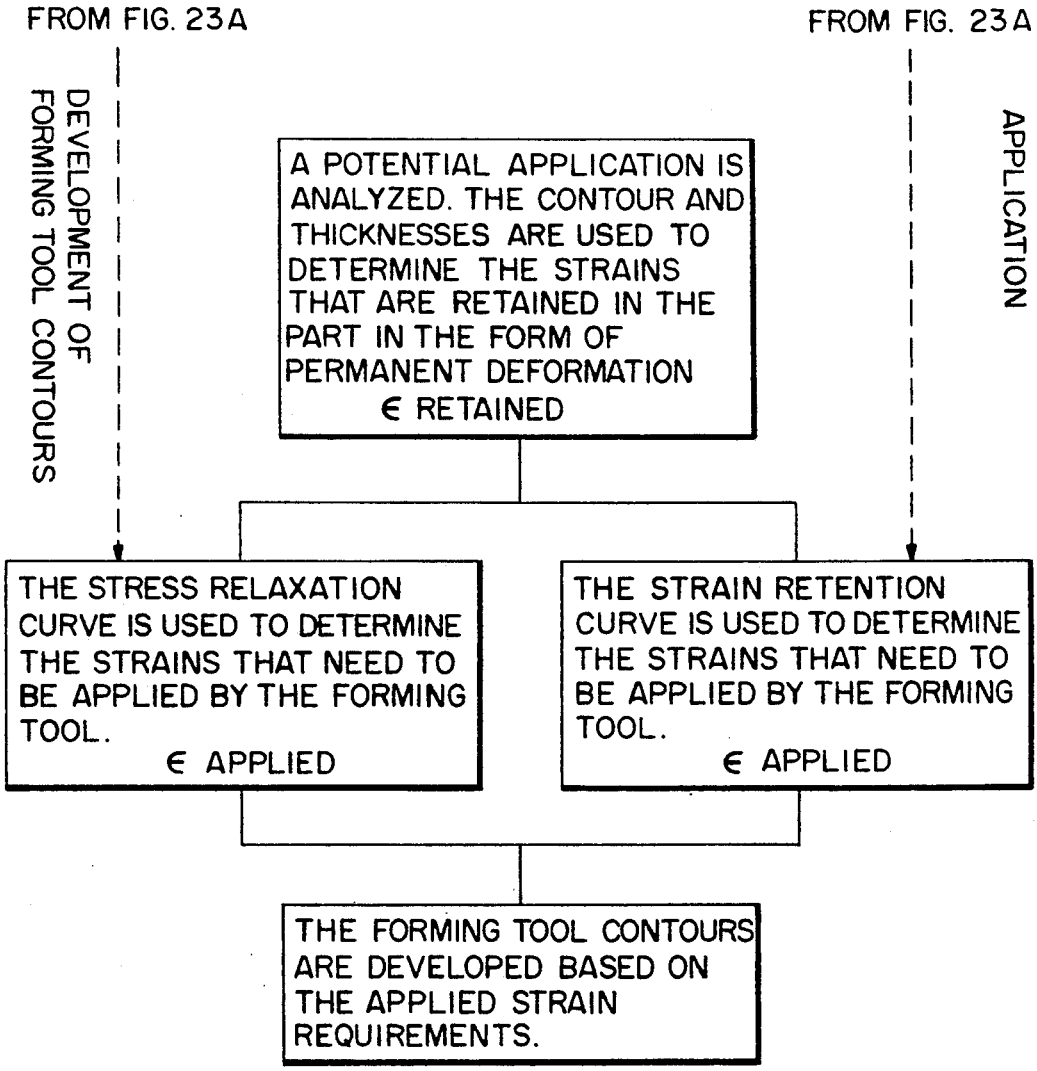

Recapitulating, generally following the flow chart of FIG. 23, the predictive methodology of the invention can be utilized for determining tool surfaces needed for age forming large panels, such as those used in wing skins and launch vehicle segments. This method requires the use of the stress relaxation curve or the strain retention curve methodology for determining the level of strain that will be applied in the forming tool. The first step of the method is to analyze the required contour that the panel will have to assume upon forming. Using a suitable computerized graphics system, the formed panel contour is modelled and analyzed. The panel contour is divided into a series of imaginary chordwise cuts or slices, as schematically shown by planes a, b, c, d, e, and f in FIG. 18A. Each cut is then individually analyzed (FIG. 18B) and approximated by a radius. Each contour cut in the example is then divided into three individual segments $S_1$, $S_2$, $S_3$ (FIG. 18C), due to corresponding changes in the panel thickness. For nonsymmetrical sections, such as airfoil shapes, this would require the original contour cut to be approximated by a series of radii. Each radius is then evaluated in conjunction with the panel thickness found in the corresponding area to determine the strain which must be retained in the part. In some cases, panel thickness changes and section contour dictate how many segments the original contour cut is divided into. The approximate radius of each section and the corresponding panel thickness are used to determine the strain that a flat panel must retain in order to assume the desired shape. Knowing the retained strain, the initial strain that is to be applied in the forming tool can be determined from a stress relaxation curve or a strain retention curve for the panel alloy.

Utilizing strain retention curve methodology, for example, this can be accomplished by applying the retained strain value to a polynominal equation developed from the strain retention curve for the particular alloy of interest. For example, each bar specimen, numerically indicated in Table 1 and depicted diagrammatically in FIGS. 6A, 6B, and 6C, yields a combination of thickness and tool radius which provides an initial or applied strain (FIG. 6B):

$$\epsilon_{applied} = -y/\rho = \frac{\text{thickness}/2}{\text{neutral surface radius of part in tool}}$$

where y is the distance from the neutral surface at the point where the strain is acting (FIG. 1) and $\rho$ is the radius of curvature of the neutral surface. For a rectangular cross section, $\rho$ is equal to the tool radius minus one half of the thickness of the cross section (FIG. 6B). By definition, no strain occurs at the neutral surface. This equation can be used to determine bending strain occurring at any point through the thickness of the material.

After forming, each formed bar speciment can be used to determine a retained strain:

$$\epsilon_{retained} = \frac{\text{thickness}/2}{\text{neutral surface radius of formed part}}$$

The only difference between $\epsilon_{applied}$ and $\epsilon_{retained}$ is that in calculating $\epsilon_{applied}$ for a part having a rectangular cross section, the radius of the neutral surface of the part cross section is equal to $\rho$, that is, the tool radius minus one half the part thickness, while in calculating $\epsilon_{retained}$, the radius of the neutral surface of the part cross section is equal to the radius of the convex side of the formed part minus t/2. In general:

$$\epsilon_{applied} >> \epsilon_{retained}$$

$$\rho_{tool} << \rho_{formed\ part}.$$

Figure 19:
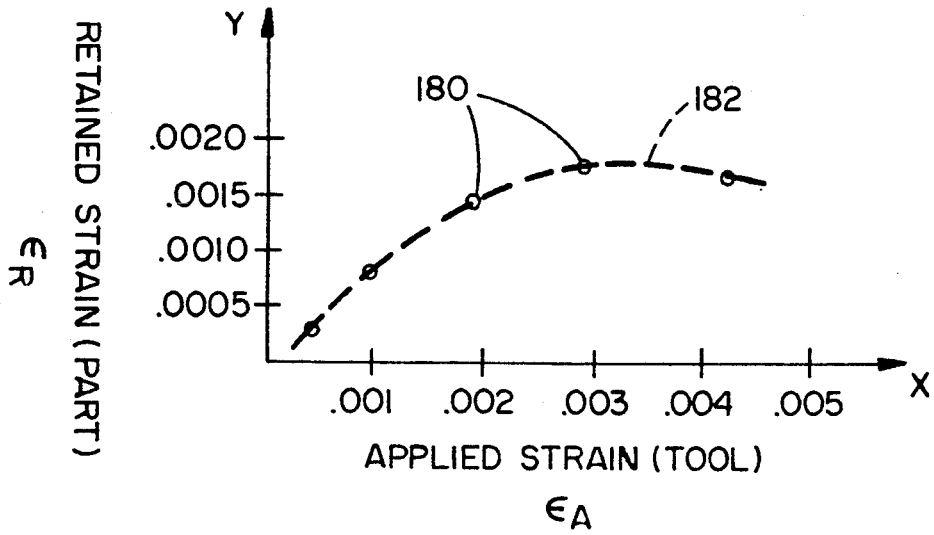
FIG. 19 is a graph of applied strain versus retained strain provided for purposes of explanation of the invention.

Each bar specimen yields one data point on the strain retention curve ($\epsilon_{applied}$, $\epsilon_{retained}$). After several bar tests have been performed, a series of data points 180 (FIG. 19) are generated that can be used to construct a curve 182. The data points can also be used to determine a polynomial equation which, in effect, is a curve fit equation. For a second order curve fit, the equation would generally be in the form:

$$y = Px^2 + Qx + R$$

where P, Q, and R are constants, y is the applied strain (strain applied by the tool) and x is the retained strain (strain retained in the part).

Knowing the applied strain level (as calculated) and the thickness allows a tool radius to be calculated.

$$\epsilon_{applied} = \frac{t/2}{\rho_{neutral\ surface\ of\ part\ in\ tool}}; \text{and}$$

$$\rho_{neutral\ surface\ of\ part\ in\ tool} = \rho_{tool} - t/2$$

Therefore, $$\rho_{tool} - t/2 = \frac{t/2}{\epsilon_{applied}};$$

$$\rho_{tool} = \frac{t/2}{\epsilon_{applied}} + t/2$$

Figure 20:
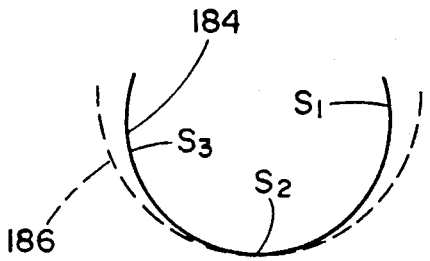
FIG. 20 is a diagrammatic view generally illustrating the relative contour of a tool embodying the present invention and of a part resulting from that tool.
Figure 21:
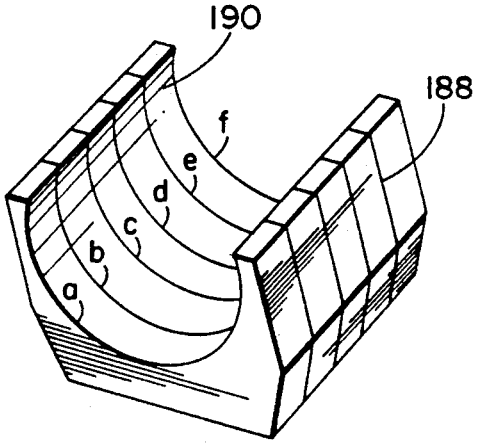
FIG. 21 is a detail perspective view of a tool embodying the present invention.

A tool radius is calculated in this manner for each section of the original panel contour. Individual curve segments are created based on the original segment length and the calculated tool radius. These curve segments are then assembled into a tool contour curve 184 so as to produce a part having a contour 186, as shown in FIG. 20. Each segment has a corresponding factor built in for springback. Tool curves, each composed of several tool radii calculations, can be determined for as many imaginary panel section cuts (represented by planes a, b, c, d, e, f) as are necessary to adequately define the overall contour of the age forming tool surface. A smooth surface flowing from one tool curve to the next represents the desired predicted surface of the age forming tool. This result is shown in FIG. 20 for a single panel section cut (as represented by planes a, b, c, d, e, f) and in a completed tool 188 as seen in FIG. 21 which incorporates several of such section cuts in succession.

Figure 22:
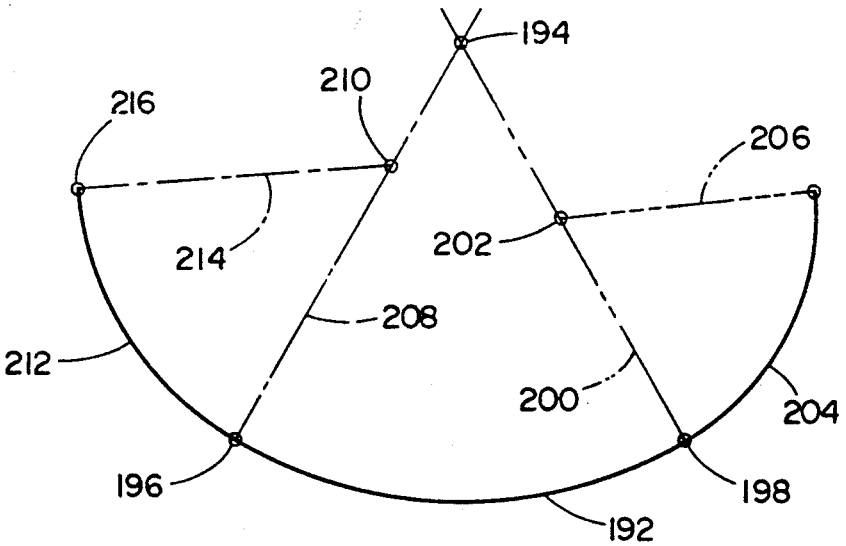
FIG. 22 presents a graphic illustration of the method by which a smooth continuous surface is achieved utilizing the present invention.

A procedure for developing a finsihed surface 190 for the tool 188 will now be described with the aid of FIG. 22. The procedure is initiated by drawing a tool curve segment 192, preferably from the most central segment, that is, segment $S_2$ in FIG. 18C. The tool curve segment 192 has a center point 194 and extends between end points 196 and 198. A line 200, which is a radius of the arc of the tool curve segment 192, is drawn so as to connect center point 194 with end point 198. Thereupon, a center point 202 is located on the line 200 such that the distance between the center point 202 and the end point 198 is equal to the radius of an adjacent tool curve segment 204 which relates to the segment $S_1$ in FIG. 18C. A line 206 represents the radius of the arc of the tool curve segment 204.

To develop the other side of the tool curve, a line 208 is extended between the center point 194 and the end point 196 and a center point 210 for the arc of a tool curve segment 212 is properly positioned on the line 208. As in the instances previously provided, the tool curve segment 212 relates to the tool segment $S_3$ depicted in FIG. 18C. Thus, a line 214 extending between the center point 210 and an end point 216 for the curve segment 212 distant from the end point 196 represents a radius of the tool curve segment 212.

Figure 18A:
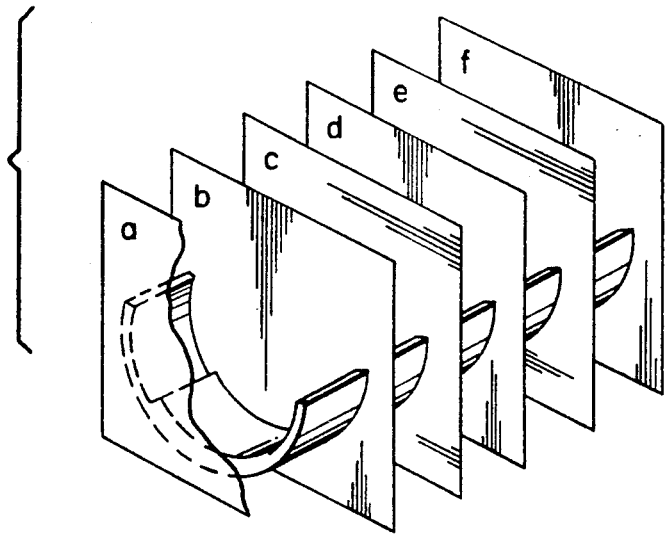
FIGS. 18A, 18B, and 18C diagrammatically illustrate three steps in the method of the invention.
Figure 18B:
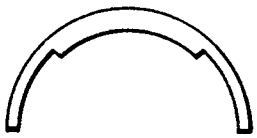
Figure 18C:
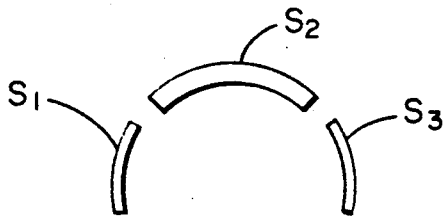

Throughout the procedure just described, it will be appreciated that the arc of the tool curve segment 192 is tangent to the arc of the tool segment 204 at the end point 198 and, similarly, that the arc of the tool curve segment 192 is tangent to the arc of the tool curve segment 212 at the end point 196. In this fashion, a smooth transition is achieved from each tool curve segment to its adjacent tool curve segment or segments. This procedure is performed for each of the cuts represented by the planes a, b, c, d, e, and f as seen in FIGS. 18A and 21. It will also be appreciated that there may be a very large number of such cuts, or planes, closely spaced together to improve upon the transition from one plane to its adjacent plane. In this manner, a smooth surface flowing from one tool curve to next can be obtained which represents the desired predicted surface contour of the autoclave age forming tool. Three dimensional surfaces can be constructed through the individual tool curves. These surfaces can be analyzed and used to generate additional tool definition, such as might be needed for the fabrication of the tool.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A method of developing the surface contour of a desired tool for use in age forming an unformed aluminum alloy member to produce a desired complex shaped member, said method comprising the steps of:

(a) providing a plurality of experimental forming tools having substantially different radii of curvature;

(b) age forming each of a plurality of sets of specimens of the aluminum alloy, all of the specimens having a uniform width and length, the specimens of each set being of uniform thickness, the specimens of different sets being of different thicknesses such that each individual specimen of a set is constrained to a different one of the experimental forming tools;

(c) cooling all of the specimens to substantially the same temperature;

(d) after step (c), releasing each of the specimens from restraint;

(e) for each specimen, on a graph on which the vertical axis represents stress and the horizontal axis represents strain, locating on the horizontal axis the value of applied strain and the value of retained strain exhibited by the specimen;

(f) for each specimen, plotting on the graph an unload line having the slope of the modulus of elasticity for the specimen at the release temperature of step (d) so as to pass through the retained strain exhibited by the specimen;

(g) on the graph, constructing a line of infinite slope passing through the point of applied strain;

(h) on the graph, plotting the point of intersection of the unload line of step (f) with the applied strain line of step (g) for the specimen;

(i) plotting a plurality of points of intersection for the plurality of specimens;

(j) joining all of the points so plotted to form a stress relaxation curve;

(k) expressing the stress relaxation curve as a mathematical expression;

(l) determining from the stress relaxation curve the value of the applied strain to be applied by the tool to the unformed member during age forming to achieve the value of retrained strain necessary to produce the desired complex shaped member, there being a mathematical relationship between applied strain and the radius of curvature of a forming tool for forming the desired member; and (l-1) knowing the applied strain, mathematically calculating the radius of curvature of the tool for forming the desired complex shaped member.

2. A method as set forth in claim 1 wherein step (b) includes the steps of:

(m) overforming each specimen in a tool having a contour of smaller curvature than the contour of a desired member;

(n) constraining the specimen in the overformed condition;

(o) applying a standard thermal aging cycle to the constrained specimen;

(p) cooling the constrained specimen following the standard thermal aging cycle;

(q) releasing the constrained specimen from the condition imparted by step (n) and allowing it to spring back to a dimensionally stable condition which defines the desired member.

3. A method as set forth in claim 2 wherein steps (m) and (n) include the step of:

mechanically clamping the unformed member to conform to the shape of the tool; and wherein step (o) is performed in a furnace.

4. A method as set forth in claim 2 wherein steps (m) and (n) include the step of:

(s) applying pressure and/or vacuum to the unformed member to constrain it to the shape the tool; and wherein step (o) is performed in an autoclave.

5. A method as set forth in claim 1 wherein the mathematical expression for performing step (l-1) is:

$$\rho_{tool} = \frac{t/2}{\epsilon_{applied}} + t/2; \text{ and}$$

where $\rho_{tool}$ represents the tool radius of curvature, t represents the thickness of the specimen, and where $\epsilon_{applied}$ is applied strain.

6. A method as set forth in claim 1 including the steps, after executing step (l-1), of:

(u) providing a model of the desired complex shaped aluminum alloy member;

(v) passing a plurality of imaginary spaced apart planes through the model of the desired member at spaced apart locations to thereby form a plurality of imaginary cross sectional elements; p1 (w) dividing each of the imaginary cross sectional elements into a plurality of imaginary segments, each having a substantially uniform thickness and a substantially uniform radius of curvature;

(x) determining from the stress relaxation curve an applied strain for the retained strain sought for each imaginary segment;

(y) determining the tool radius for each imaginary segment from a known relationship between the applied strain determined in step (x) and the tool radius;

(z) from the tool radii calculated in step (y), developing tool curves for each of the imaginary planes of step (v) and thereby developing a surface contour for the tool.

7. A method as set forth in claim 6 wherein the known relationship between the applied strain determined in step (x) and the tool radius as required to perform step (y) is:

$$\rho_{tool} = \frac{t/2}{\epsilon_{applied}} + t/2; \text{ and}$$

wherein $\rho_{tool}$ is the tool radius, t is the thickness of the aluminum member, and $\epsilon_{applied}$ is the applied strain imparted to the aluminum member by the tool.

8. A method as set forth in claim 1 wherein the desired member is composed of a precipitation heat treatable aluminum alloy.

9. A method as set forth in claim 1 wherein there is at least one specimen having one of the plurality of different thicknesses for each experimental forming tool having a specific radius of curvature.

10. A method as set forth in claim 1 wherein the mathematical expression of step (k) is a quadratic equation.

11. A method as set forth in claim 10 wherein the quadratic equation is of the form:

$$y = Ax^2 + Bx + C$$

where A, B, and C are constants, y is the stress $\sigma$ experienced by a specimen, and where x is the applied strain.

12. A method as set forth in claim 1 wherein step (b) includes the application of at least one of pressure on one side and vacuum on an opposite side of each specimen.

13. A method as set forth in claim 10 wherein step (e) includes the steps of:

(aa) for each specimen, plotting on a graph where the vertical axis represents a normalized stress in which stress has been divided by the modulus of elasticity and the horizontal axis represents strain; and (ab) for each specimen, locating on the horizontal axis the value of applied strain and the value of retained strain exhibited by the specimen;

wherein step (f) includes the step of:

(ac) for each specimen, plotting on the graph an unload line having the slope of one so as to pass through the retained strain exhibited by the specimen;

wherein the stress relaxation curve in each of steps (j), (k) and (l) is a normalized stress relaxation curve; and wherein the quadratic equation is of the form:

$$y = Ax^2 + Bx + C$$

where A, B, and C are constants, y is normalized stress $\sigma/E$ where $\sigma$ is stress experienced by a specimen and E is the modulus of elasticity of the aluminum alloy, and where x is the applied strain.

14. A method of developing the surface contour of a desired tool for use in age forming an unformed aluminum alloy member to produce a desired shaped member, the method comprising the steps of:

(a) applying to each specimen of a plurality of aluminum alloy specimens having uniform dimensions a sufficient stress to achieve a plurality of predetermined applied strains;

(b) constraining each specimen while subjected to the predetermined strain;

(c) applying to each constrained specimen a standard thermal aging cycle for the particular alloy of the specimens;

(d) cooling each constrained specimen following the thermal aging cycle;

(e) releasing each specimen upon the conclusion of step (d), allowing it to achieve a final retained strain;

(f) for each specimen, on a graph on which the vertical axis represents stress and the horizontal axis represents strain, locating on the horizontal axis the value of applied strain and the value of retained strain exhibited by the specimen;

(f1) passing an imaginary line having the slope of the modulus of elasticity for the aluminum alloy of the specimen through the point of final retained strain;

(g) marking the point of intersection of the imaginary line developed in the preceding step with a line of constant strain representing the applied strain to which the specimen was subjected;

(h) joining all of the points developed in step (g) for each of the specimens, thereby forming a stress relaxation curve indicative of applied strain for a range of stresses applied to aluminum alloy specimens of uniform dimension and subjected to a standard thermal aging cycle;

(i) expressing the stress relaxation curve as a mathematical expression;

(j) determining from the stress relaxation curve the value of the applied strain to be applied by the tool to the unformed member during age forming to achieve the value of retained strain necessary to produce the desired complex shaped member, there being a mathematical relationship between applied strain and the radius of curvature of a forming tool for forming the desired member; and (k) knowing the applied strain, mathematically calculating the radius of curvature of the tool for forming the desired shaped member.

15. A method as set forth in claim 14 wherein step (f) includes the steps of:

(i) for each specimen, plotting on a graph where the vertical axis represents a normalized stress in which stress has been divided by the modulus of elasticity and the horizontal axis represents strain; and wherein the stress relaxation curve in step (h) is a normalized stress relaxation curve; and wherein the imaginary line of step (f1) is an unloading line defined by the equation:

$$\sigma = E(\epsilon - \epsilon_{retained})$$

where $\sigma$ is stress experienced by a specimen, E is the modulus of elasticity of the aluminum alloy, $\epsilon$ is strain experienced by a specimen and $\epsilon_{retained}$ is the retained strain experienced by the specimen; and including the step of:

(j) dividing both sides of the unloading line equation by the modulus of elasticity of the aluminum alloy to thereby normalize the equation such that the slope of the unloading line becomes equal to one;

whereby knowledge of the modulus of elasticity of the specimen is not necessary for developing said normalized stress relaxation curve so long as step (e) is performed at the same temperature for each specimen.

16. A method of forming a desired aluminum alloy member having a surface contour of complex shape from an unformed member comprising the steps of:

(a) overforming the unformed member in a tool having a contour of smaller curvature than the contour of the desired member;

(b) constraining the unformed member in the overformed condition;

(c) applying a standart thermal aging cycle to the constrained member;

(d) cooloing the constrained member following the standart thermal againg cycle;

(e) releasing the constrained member from the condition imparted by step (b) and allowing it to spring back to a dimensionally stable condition which defines the desired member having a surface contour of complex shape;

wherein step (a) includes the steps of:

(f) developing a stress relaxation curve for a plurality of specimens having a plurality of different thicknesses, the stress relaxation curve representing a relationship between applied stress, applied strain (the strain imparted by the tool on the specimen), and retained strain (the strain permanently retained by the specimen); and (g) determining from the stress relaxation curve the valve of the applied strain necessary for step (a) to achieve the value of retained strain necessary to produce the desired member following step (e).

17. A method as set forth in claim 16 wherein the member is composed of a precipitation heat treatable aluminum alloy.

18. A method as set forth in claim 16 including the steps, after executing step (g), of:

(h) providing a model of the desired complex shaped aluminum alloy member;

(i) passing a plurality of imaginary spaced apart planes through the model of the desired member at spaced at spaced apart locations to thereby form a plurality of imaginary cross sectional elements;

(j) dividing each of the imaginary cross sectional elements into a plurality of imaginary segments, each having a substantially uniform thickness and a substantially uniform radius of curvature;

(k) determining from the stress relaxation curve an applied strain for the retained strain sought for each imaginary segment;

(l) determining the tool radius for each imaginary segment from a known relationship between the applied strain determined in step (k) and the tool radius;

(m) from the tool radii calculated in step (1), developing tool curves for each of the imaginary planes of step (i) and thereby developing a surface contour for the tool.

19. A method as set forth in claim 18 wherein the known relationship between the applied strain and the tool radius for determining the tool radius in step (l) is:

$$\rho_{tool} = \frac{t/2}{\epsilon_{applied}} + t/2; \text{ and}$$

wherein $\rho_{tool}$ is the tool radius, t is the thickness of the aluminum member, and $\epsilon_{applied}$ is the applied strain imparted to the aluminum member by the tool.

20. A method of developing the surface contour of a desired tool use in age forming an unformed aluminum alloy member to produce a desired complex shaped aluminum alloy member, said method comprising the steps of:

(a) providing a plurality of experimental forming tools having substantially different radii of curvature;

(b) age forming each of a plurality of sets of specimens of the aluminum alloy, all of the specimens having a uniform width and length, the specimens of each set being of uniform thickness, the specimens of different sets being of different thickness such that each set of specimens having the same thickness is constrained to the experimental forming tools having different radii of curvature;

(c) colling all of the specimens to substantially the same temperature;

(d) after step (c), releasing each of the specimens from restraint;

(e) for each specimen, plotting a graph of applied strain versus retained strain as exhibited by the specimen;

(f) joining all of the points so plotted to form a strain retention curve;

(g) expressing the strain retention curve as a mathematical expresssion; and (h) determining from the strain retention curve the value of the applied strain to be applied by the tool to the unformed member during age forming to achieve the value of retained strain necessary to produce the desired complex shaped member, there being a mathematical relationship between applied strain and the radius of curvature of a forming tool for forming the desired member; and (h-1) knowing the applied strain, mathematically calculating the radius of curvature of the tool for forming the desired complex shaped member.

21. A method as set forth in claim 20 wherein the step of age forming includes the steps of:

(i) overforming each specimen in a tool having a contour of smaller curvature than the contour of a desired member;

(j) constraining the specimen in the overformed condition;

(k) applying a standard thermal aging cycle to the constrained specimen;

(l) cooling the constrained specimen following the standard thermal aging cycle;

(m) releasing the constrained speciment from the condition imparted by step (j) and allowing it to spring back to a dimensionally stable condition which defines the desired member.

22. A method as set forth in claim 21 wherein steps (i) and (j) include the step of:

(n) mechanically clamping the unformed member to conform to the shape of the tool; and wherein step (k) is performed in a furnace.

23. A method as set forth in claim 21 wherein steps (i) and (j) include the step of:

(o) applying pressure and/or vacuum to the unformed member to constrain it to the shape of the tool; and wherein step (k) is performed in an autoclave.

24. A method as set forth in claim 20 wherein the mathematical expression for performing step (h-1) is:

$$\rho_{tool} = \frac{t/2}{\epsilon_{applied}} + t/2; \text{ and}$$

where $\rho_{tool}$ represents the tool radius of curvature, t represents the thickness of the specimen, and where $\epsilon_{applied}$ is strain.

25. A method as set forth in claim 20 including the steps, after executing step (h-1), of:

(q) providing a model of the desired complex shaped aluminum alloy member;

(r) passing a plurality of imaginary spaced apart planes through the model of the desired member at spaced apart locations to thereby form a plurality of imaginary cross sectional elements;

(s) dividing each of the imaginary cross sectional elements into a plurality of imaginary segments, each having a substantially uniform thickness and a substantially uniform radius of curvature;

(t) determining from the strain retention curve an applied strain for the retained strain sought for each imaginary segment;

(u) determining the tool radius for each imaginary segment from a known relationship between the applied strain determined in step (t) and the tool radius;

(v) from the tool radii calculated in step (u), developing tool curves for each of the imaginary planes of step (r) and thereby developing a surface contour for the tool.

26. A method as set forth in claim 25 wherein the known relationship between the applied strain determined in step (t) and the tool radius as required to perform step (u) is:

$$\rho_{tool} = \frac{t/2}{\epsilon_{applied}} + t/2; \text{ and}$$

wherein $\rho_{tool}$ is the tool radius, t is the thickness of the aluminum member, and $\epsilon_{applied}$ is the applied strain imparted to the aluminum member by the tool.

27. A method as set forth in claim 20 wherein the desired member is composed of a precipitation heat treatable aluminum alloy.

28. A method as set forth in claim 20 wherein there is at least one specimen having one of the plurality of different thickness for each experimental forming tool having a specific radius of curvature.

29. A method as set forth in claim 20 wherein the mathematical expression of step (g) is a quadratic equation.

30. A method as set forth in claim 29 wherein the quadratic equation is of the form:

$$y = Px_2 + Qx + R$$

where P, Q, and R are constants, y is applied strain, and where x is retained strain.

31. A method as set forth in claim 20 wherein step (b) includes the application of at least one of pressure on one side and vacuum on an opposite side of each specimen.

32. A method of forming a desired aluminum alloy member having a surface contour of complex shape from an unformed member comprising the steps of:

(a) overforming the member in a tool having a contour of smaller curvature than the contour of the desired member;

(b) constraining the member in the overformed condition;

(c) applying a standard thermal aging cycle to the constrained member;

(d) cooling the member while constrained following the standard thermal aging cycle;

(e) releasing the member from its constrained condition imparted by step (b) and allowing it to spring back to a dimensionally stable condition which defines the desired member having a surface contour of complex shape;

wherein step (a) includes the steps of:

(f) developing a strain retention curve for a plurality of specimens having a plurality of different thickness, the strain retention curve representing a relationship between applied strain, (the strain imparted by the tool on the specimen) and retained strain (the strain permanently retained by the specimen); and (g) determining from the strain retention curve the value of the applied strain necessary for step (a) to achieve the value of retained strain necessary to produce the desired member following step (e).

33. A method as set forth in claim 32 wherein the member is composed of a precipitation heat treatable aluminum alloy.

34. A method as set forth in claim 32 including the steps, after executing step (g), of:

(h) providing a model of the desired complex shaped aluminum alloy member;

(i) passing a plurality of imaginary spaced apart planes through the model of the desired member at spaced apart locations to thereby form a plurality of imaginary cross sectional elements;

(j) dividing each of the imaginary cross sectional elements into a plurality of imaginary segments, each having a substantially uniform thickness and a substantially uniform radius of curvature.

(k) determining from the strain retention curve an applied strain for the retained strain sought for each imaginary segment;

(l) determining the tool radius for each imaginary segment from a known relationship between the applied strain determined in step (k) and the tool radius;

(m) from the tool radii calculated in step (l), developing tool curves for each of the imaginary planes of step (i) and thereby developing a surface contour for the tool.

35. A method as set forth in claim 34 wherein the known relationship between the applied strain and the tool radius for determining the tool radius in step (l) is:

$$\rho_{tool} = \frac{t/2}{\epsilon_{applied}} + t/2; \text{ and}$$

wherein $\rho_{tool}$ is the tool radius, t is the thickness of the aluminum member, and $\epsilon_{applied}$ is the applied strain imparted to the aluminum member by the tool.

36. A method of developing the surface contour of a desired tool for use in age forming an unformed aluminum alloy member to produce a desired complex shaped member, said method comprising the steps of:

(a) age forming each of a plurality of sets of specimens of the aluminum alloy, all of the specimens having a uniform width and length, the specimens of each set being of uniform thickness, the specimens of different sets being of different thickness such that each set of specimens is constrained to a plurality of different elevated stress levels;

(b) cooling all of the specimens to substantially the same temperature;

(c) after step (b), releasing each of the specimens from restraint;

(d) for each specimen, plotting on a graph of stress versus strain, for each applied stress, the applied strain and the retained strain exhibited by the specimen;

(e) for each specimen, plotting on the graph an unload line having the slope of the modulus of elasticity for the specimen at the release temperature of step (c) so as to pass through the retained strain exhibited by the specimen;

(f) on the graph, constructing a line of infinite slope passing through the point of applied strain;

(g) on the graph, plotting the point of intersection of the unload line of step (e) with the applied strain line of step (f) for the specimen;

(h) plotting a plurality of points of intersection for the plurality of specimens;

(i) joining all of the points so plotted to form a stress relaxation curve;

(j) expressing the stress relaxation curve as a mathematical expression; and (k) determining from the stress relaxation curve the value of the applied strain to be applied by the tool to the unformed member during age forming to achieve the value of retained strain necessary to produce the desired complex shaped member, there being a mathematical relationship between applied strain and the radius of curvature of a forming tool for forming the desired member; and (k-1) knowing the applied strain, mathematically calculating the radius of curvature of the tool for forming the desired complex shaped member.

37. A method as set forth in claim 36 wherein the step of age forming includes the steps of:

(l) overforming each specimen;

(m) constraining the specimen in the overformed condition;

(n) applying a standard thermal aging cycle to the constrained specimen;

(o) cooling the constrained specimen following the standard thermal aging cycle;

(p) releasing the constrained specimen from the condition imparted by step (m) and allowing it to spring back to a dimensionally stable condition which defines the desired member.

38. A method as set forth in claim 36 wherein the desired member is composed of a precipitation heat treatable aluminum alloy.

39. A method of developing the surface contour of a desired tool for use in age forming an unformed aluminum alloy member to produce a desired complex shaped member, said method comprising the steps of:

(a) age forming each of a plurality of sets of specimens, each set of specimens having similar dimensions and the specimens of different sets being of different thicknesses such that each set of specimens is constrained to a plurality of different elevated stress levels;

(b) cooling all of the specimens to substantially the same temperature;

(c) after step (b), releasing each of the specimens from restraint;

(d) for each specimen, plotting a graph of applied strain versus retained strain as exhibited by the specimen;

(e) joining all of the points so plotted to form a strain retention curve;

(f) expressing the strain retention curve as a mathematical expression; and (g) determining from the strain retention curve the value of the applied strain to be applied by the tool to the unformed member during age forming to achieve the value of retained strain necessary to produce the desired complex shaped member, there being a mathematical relationship between applied strain and the radius of curvature of a forming tool for forming the desired member; and (g-1) knowing the applied strain, mathematically calculating the radius of curvature of the tool for forming the desired complex shaped member.

40. A method as set forth in claim 39 wherein the step of age forming including the steps of:

(h) overforming each specimen;

(i) constraining the specimen in the overformed condition;

(j) applying a standard thermal aging cycle to the constrained specimen;

(k) cooling the constrained specimen following the standard thermal again cycle;

(l) releasing the constrained specimen from the condition imparted by step (i) and following it to spring back to a dimensionally stable condition which defines the desired member.

41. A method as set forth in claim 39 wherein the desired member is composed of a precipitation heat treatable aluminum alloy.

* * * * *

UNITED STATES PATENT AND TRADEMARK OFFICE

CERTIFICATE OF CORRECTION

PATENT NO. : 5,168,169

DATED : December 1, 1992

INVENTOR(S) : Brewer, Jr. et al.

It is certified that error appears in the above-identified patent and that said Letters Patent is hereby corrected as shown below:

IN THE CLAIMS:

Claim 4, col. 22, line 35 after "shape" insert --of--.

Claim 6, col. 22, line 55 delete "pl".

Claim 16, col. 25, line 15 delete "standart" and insert --standard--.

Claim 16, col. 25, line 17 delete "cooloing" and insert --cooling--.

Claim 16, col. 25, line 18 delete "standart" and insert --standard--.

Claim 16, col. 25, line 18 delete "againg" and insert --aging--.

Claim 16, col. 25, line 34 delete "valve" and insert --value--.

Claim 18, col. 25, line 47 delete "at spaced".

Claim 20, col. 26, line 25 delete "colling" and insert --cooling--.

Claim 21, col. 26, line 58 delete "speciment" and insert --specimen--.

Claim 30, col. 27, line 64 delete "$y=Px_2+Qx+R$ and insert --$y=Px^2+Qx+R$--.

UNITED STATES PATENT AND TRADEMARK OFFICE

CERTIFICATE OF CORRECTION

PATENT NO. : 5,168,169 Page 2 of 2

DATED : December 1, 1992

INVENTOR(S) : Brewer, Jr., et al

It is certified that error appears in the above-indentified patent and that said Letters Patent is hereby corrected as shown below:

Claim 32, col. 28, lines 24-25 delete "thickness" and insert --thicknesses--.

Claim 40, col. 30, line 52 delete "following" and insert --allowing--.

Signed and Sealed this

Seventh Day of December, 1993

*Attest:*

*Attesting Officer*

BRUCE LEHMAN

*Commissioner of Patents and Trademarks*